US010591220B2

(12) United States Patent
Bluetling

(10) Patent No.: US 10,591,220 B2
(45) Date of Patent: Mar. 17, 2020

(54) MULTI-FLUID HEAT EXCHANGER

(71) Applicant: Dana Canada Corporation, Oakville (CA)

(72) Inventor: Jens Bluetling, Neu-Ulm (DE)

(73) Assignee: Dana Canada Corporation, Oakville (CA)

( * ) Notice: Subject to any disclaimer, the term of this patent is extended or adjusted under 35 U.S.C. 154(b) by 63 days.

(21) Appl. No.: 16/119,649

(22) Filed: Aug. 31, 2018

(65) Prior Publication Data

US 2019/0063846 A1 Feb. 28, 2019

Related U.S. Application Data

(60) Provisional application No. 62/552,505, filed on Aug. 31, 2017.

(51) Int. Cl.

| | |
|---|---|
| ***F28D 7/10*** | (2006.01) |
| ***F28D 9/00*** | (2006.01) |
| *F28D 21/00* | (2006.01) |
| *F28D 7/00* | (2006.01) |

(52) U.S. Cl.

CPC ..... *F28D 9/0093* (2013.01); *F28D 9/005* (2013.01); *F28D 7/0066* (2013.01); *F28D 2021/0089* (2013.01)

(58) Field of Classification Search

CPC ..... F28D 7/0066; F28D 9/0093; F28D 9/005
USPC ..... 165/140
See application file for complete search history.

(56) References Cited

U.S. PATENT DOCUMENTS

| | | | | | |
|---|---|---|---|---|---|
| 2,596,008 | A | * | 5/1952 | Collins | F28D 9/0037 165/167 |
| 3,126,942 | A | * | 3/1964 | Tyler | F28F 3/00 239/75 |
| 3,590,917 | A | | 7/1971 | Huber et al. | |
| 4,081,025 | A | | 3/1978 | Donaldson | |
| 4,162,703 | A | | 7/1979 | Bosaeus | |
| 4,176,713 | A | | 12/1979 | Fisher | |
| 4,407,359 | A | | 10/1983 | Berger et al. | |
| 4,872,578 | A | | 10/1989 | Fuerschbach et al. | |
| 5,462,113 | A | * | 10/1995 | Wand | F28D 9/005 165/140 |
| 5,964,280 | A | * | 10/1999 | Wehrmann | F28D 9/005 165/140 |
| 6,142,221 | A | * | 11/2000 | Johansson | F28D 9/0093 165/140 |

(Continued)

*Primary Examiner* — Paul Alvare
(74) *Attorney, Agent, or Firm* — Ridout and Maybee LLP

(57) ABSTRACT

A nested dish-plate heat exchanger is disclosed wherein the heat exchanger core is comprised of a plurality of first and second heat exchanger plates arranged in alternating stacked relationship. The first and second heat exchanger plates each have a pair of openings formed in the base portion of the plates and a pair of upwardly protruding boss portions and a pair of downwardly protruding bosses each having a corresponding opening formed therein. The first and second heat exchanger plates are arranged in an alternating stacked relationship wherein each subsequent first or second heat exchanger plate is rotation 180 degrees with respect to the previous first or second heat exchanger plate in the stack, the arrangement providing a plurality of first, second and third fluid flow passages therebetween such that each of the second and third fluid flow passages are in heat transfer relationship with the first fluid flow passages.

23 Claims, 15 Drawing Sheets

(56) References Cited

U.S. PATENT DOCUMENTS

| | | | | |
|---|---|---|---|---|
| 6,164,371 | A * | 12/2000 | Bertilsson | F28D 9/005 165/140 |
| 6,305,466 | B1 * | 10/2001 | Andersson | F28D 9/005 165/140 |
| 6,564,862 | B1 * | 5/2003 | Persson | F28D 9/0093 165/140 |
| 6,681,846 | B2 | 1/2004 | Angermann et al. | |
| 7,051,799 | B2 | 5/2006 | Wu et al. | |
| 7,168,483 | B2 | 1/2007 | Blomgren et al. | |
| 7,775,264 | B2 * | 8/2010 | Andersson | F28D 9/005 165/167 |
| 7,946,339 | B2 | 5/2011 | So et al. | |
| 8,109,326 | B2 | 2/2012 | Larsson et al. | |
| 8,191,615 | B2 | 6/2012 | So et al. | |
| 8,376,036 | B2 | 2/2013 | Kammerzell | |
| 9,518,782 | B2 | 12/2016 | Blomgren et al. | |
| 2006/0266501 | A1 * | 11/2006 | So | F28D 1/0246 165/140 |
| 2008/0121381 | A1 * | 5/2008 | So | F28D 1/0333 165/140 |
| 2011/0083833 | A1 * | 4/2011 | Zorzin | F28D 9/005 165/166 |
| 2012/0291987 | A1 * | 11/2012 | Himmer | B60H 1/00278 165/42 |
| 2017/0030661 | A1 * | 2/2017 | Ariyama | F28D 9/005 |
| 2018/0120033 | A1 * | 5/2018 | Mougnier | F28D 9/0093 |
| 2019/0264985 | A1 * | 8/2019 | Romlund | F28D 9/0093 |

* cited by examiner

MULTI-FLUID HEAT EXCHANGER

CROSS-REFERENCE TO RELATED APPLICATIONS

This application claims priority to and the benefit of U.S. Provisional Patent Application No. 62/552,505 filed Aug. 31, 2017, the entirety and contents of which are incorporated herein by reference.

FIELD

The present disclosure generally relates to heat exchangers for transferring heat energy between more than two fluids.

BACKGROUND

It is known to use heat exchangers for cooling or warming various fluids within an internal combustion engine. For example, in the case of an automobile, it is common to have a radiator for cooling the engine coolant and one or more other heat exchangers for cooling fluids such as the engine oil, transmission oil, power steering fluid, etc. In an effort to reduce the number of heat exchangers required and the amount of plumbing required to complete multiple fluid circuits within the automobile engine, heat exchangers that are can cool/warm two different fluid streams with a single coolant stream are desirable. In certain applications where only one coolant stream is available, providing a single heat exchanger that is capable of providing cooling/warming to two different oil streams is particularly desirable.

Heat exchangers that can accommodate more than two fluids often have a more complex structure requiring multiple different heat exchanger plates that are arranged in a particular pattern in order to achieve the desired flow paths through the heat exchanger core. Heat exchangers requiring multiple different heat exchanger plates that each have a different structure/design are often associated with increased costs due to the more complex design requiring more complex tooling and manufacturing needs. Therefore, heat exchangers that can accommodate more than two fluid streams that have a less complicated overall structure and easier manufacturing process are desirable due to the ever increasing demand for more efficient manufacturing processes and products with reduced overall costs.

SUMMARY

In one aspect, there is provided a multifluid heat exchanger comprising: a plurality of first heat exchanger plates and a plurality of second heat exchanger plates, each of the first and second heat exchanger plates having a base portion surrounded by a peripheral edge wall, the plurality of first heat exchanger plates and the plurality of second heat exchanger plates being disposed in alternating stacked relationship such that the peripheral edge walls of adjacent first and second heat exchanger plates are disposed in sealing contact; the first and second heat exchanger plates each having a first orientation and a second orientation such that while the plurality of first heat exchanger plates and the plurality of second heat exchanger plates are disposed in their alternating stacked relationship, each subsequent first heat exchanger plate is rotated 180 degrees about an axis normal to the base portion of the first heat exchanger plate relative to a previous first heat exchanger plate in the stack, and each subsequent second heat exchanger plate is rotated 180 degrees about an axis normal to the base portion of the second heat exchanger plate relative to a previous first heat exchanger plate in the stack; a plurality of first fluid flow passages formed between adjacent first and second heat exchanger plates when both the first heat exchanger plate and the adjacent second heat exchanger plate are disposed in their first orientation or are both disposed in their second orientation; a plurality of second fluid flow passages formed between adjacent second heat exchanger plates disposed in their first orientation and first heat exchanger plates disposed in their second orientation; and a plurality of third fluid flow passages formed between adjacent second heat exchanger plates disposed in their second orientation and first heat exchanger plates disposed in their first orientation; wherein each first heat exchanger plate comprises: a first pair of first fluid openings disposed within the plane of the base portion of the first heat exchanger plates; a second pair of fluid openings that project out of the base portion of the first heat exchanger plates in a first direction such that the second pair of fluid openings are disposed in a first plate first sealing surface plane that is spaced apart from and parallel to, or substantially parallel to, the base portion; and a third pair of fluid openings that project out of the plane of the base portion of the first heat exchanger plates in a second direction opposite to the first direction such that the third pair of fluid openings are disposed in a first plate second sealing surface plane that is spaced apart from and parallel to, or substantially parallel to, the base portion; and wherein each second heat exchanger plate comprises: a first pair of fluid openings that project out of the base portion of the second heat exchanger plates in a first direction such that the first pair of fluid openings are disposed in a second plate first sealing surface plane that is spaced apart from and parallel to, or substantially parallel to, the base portion; a second pair of fluid openings disposed within the plane of the base portion of the second heat exchanger plates; and a third pair of fluid openings that project out of the plane of the base portion of the second heat exchanger plates in a second direction opposite to the first direction such that the third pair of fluid openings are disposed in a second plate second sealing surface plane that is spaced apart from and parallel to, or substantially parallel to, the base portion and disposed below both the second plate first sealing surface plane and the base portion of the second heat exchanger plates, wherein the third pair of fluid openings are larger than the first pair of fluid openings and the second pair of fluid openings of the second heat exchanger plates and are also larger than the first, second and third pairs of fluid openings in the plurality of first heat exchanger plates.

In another aspect, there is provided a heat exchanger, comprising: a plurality of first heat exchanger plates and a plurality of second heat exchanger plates, each of the first and second heat exchanger plates having a base portion surrounded by a peripheral edge wall, the base portion of each of the first and second plates having a top surface and a bottom surface; wherein each of the first heat exchanger plates comprises: a first pair of fluid openings formed in the base portion such that the first pair of fluid openings are co-planar, or substantially, co-planar with the base portion, with one opening of the first pair of fluid openings being formed at opposite ends of the first heat exchanger plates, the fluid openings being spaced apart from each other and aligned with each other along a central longitudinal axis of the heat exchanger; a second pair of fluid openings formed in corresponding boss portions that project out of the top surface of the base portion, each of the fluid openings in the second pair of fluid openings being surrounded by a sealing surface disposed in a first plate first sealing surface plane that is disposed above and parallel to, or substantially parallel to, the base portion, the corresponding boss portions being arranged at opposite ends of the first heat exchanger plates and aligned with each other along an axis that extends parallel to, or substantially parallel to, the central longitudinal axis of the heat exchanger and disposed to one side of the central longitudinal axis of the heat exchanger; and a third pair of fluid openings formed in corresponding boss portions that project out of the bottom surface of the base portion in a second direction that is opposite to the first direction, each of the fluid openings in the third pair of fluid openings being surrounded by a sealing surface disposed in a first plate second sealing surface plane that is disposed below and parallel to, or substantially parallel to, the base portion, the corresponding boss portions being arranged at opposite ends of the first heat exchanger plates and aligned with each other along an axis that extends parallel to, or substantially parallel to, the central longitudinal axis of the heat exchanger and disposed to one side of the central longitudinal axis of the heat exchanger such that the pair of third fluid openings is disposed to an opposite side of the central longitudinal axis of the heat exchanger as the second pair of fluid openings; and wherein each of the second heat exchanger plates comprises: a first pair of fluid openings formed in corresponding boss portions that project out of the top surface of the base portion of the second heat exchanger plates in a first direction, each of the fluid openings in the first pair of fluid openings being surrounded by a sealing surface disposed in a second plate first sealing surface plane that is disposed above and parallel to, or substantially parallel to, the base portion, the corresponding boss portions being arranged at opposite ends of the second heat exchanger plates and aligned with each other along the central longitudinal axis of the heat exchanger; a second pair of fluid openings formed in the base portion of each of the second heat exchanger plates such that the second pair of fluid openings are co-planar, or substantially, co-planar with the base portion of the second heat exchanger plates, with one opening of the second pair of fluid openings being formed at opposite ends of the second heat exchanger plates, the fluid openings being spaced apart from each other and aligned with each other along an axis that extends parallel to, or substantially parallel to, the central longitudinal axis of the heat exchanger and disposed to one side of the central longitudinal axis of the heat exchanger; a third pair of fluid openings formed in corresponding boss portions that project out of the bottom surface of the base portion of each of the second heat exchanger plates in a second direction that is opposite to the first direction, each of the fluid openings in the third pair of fluid openings being surrounded by a sealing surface disposed in a second plate second sealing surface plane that is disposed below and parallel to, or substantially parallel to, the base portion, the corresponding boss portions being arranged at opposite ends of the first heat exchanger plates and aligned with each other along an axis that extends parallel to, or substantially parallel to, the central longitudinal axis of the heat exchanger and disposed to one side of the central longitudinal axis of the heat exchanger such that the pair of third fluid openings is disposed to an opposite side of the central longitudinal axis of the heat exchanger as the second pair of fluid openings; wherein: the first heat exchanger plates and the second heat exchanger plates are disposed in an alternating, stacked relationship such that the peripheral edge wall of each first heat exchanger plate is disposed in sealing contact with the peripheral edge wall of an adjacent second heat exchanger plate in a fluid tight manner, the first heat exchanger plates and the second heat exchanger plates each having a first orientation and a second orientation wherein the second orientation of either the first or second heat exchanger plates is such that the first or second heat exchanger plate is rotated 180 degrees about an axis that extends normal to the base portion of either the first or second heat exchanger plate relative to a previous first or second heat exchanger plate disposed in its first orientation, the first and second heat exchanger plates being alternatingly stacked together such that each subsequent first or second heat exchanger is disposed in its second orientation relative to the previous first or second heat exchanger plate in the stack; a plurality of first fluid flow passages formed between adjacent first and second heat exchanger plates when both the first heat exchanger plate and the adjacent second heat exchanger plate are disposed in their first orientation or are both disposed in their second orientation; a plurality of second fluid flow passages formed between adjacent second heat exchanger plates disposed in their first orientation and first heat exchanger plates in their second orientation; a plurality of third fluid flow passages formed between adjacent second heat exchanger plates in their second orientation and first heat exchanger plates in their first orientation; a first pair of inlet and outlet manifolds in fluid communication with the plurality of first fluid flow passages for inletting and discharging a first heat exchange fluid to and from the heat exchanger; a second pair of inlet and outlet manifolds in fluid communication with the plurality of second fluid flow passages for inletting and discharging a second heat exchange fluid to and from the heat exchanger; a third pair of inlet and outlet manifolds in fluid communication with the plurality of third fluid flow passages for inletting and discharging a third heat exchange fluid to and from the heat exchanger; wherein the plurality of first, second and third fluid flow passages are arranged in an alternating pattern through the heat exchanger core such that the plurality of first fluid flow passages are disposed in heat transfer relationship with both the plurality of second fluid flow passages and the plurality of third fluid flow passages.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 1:
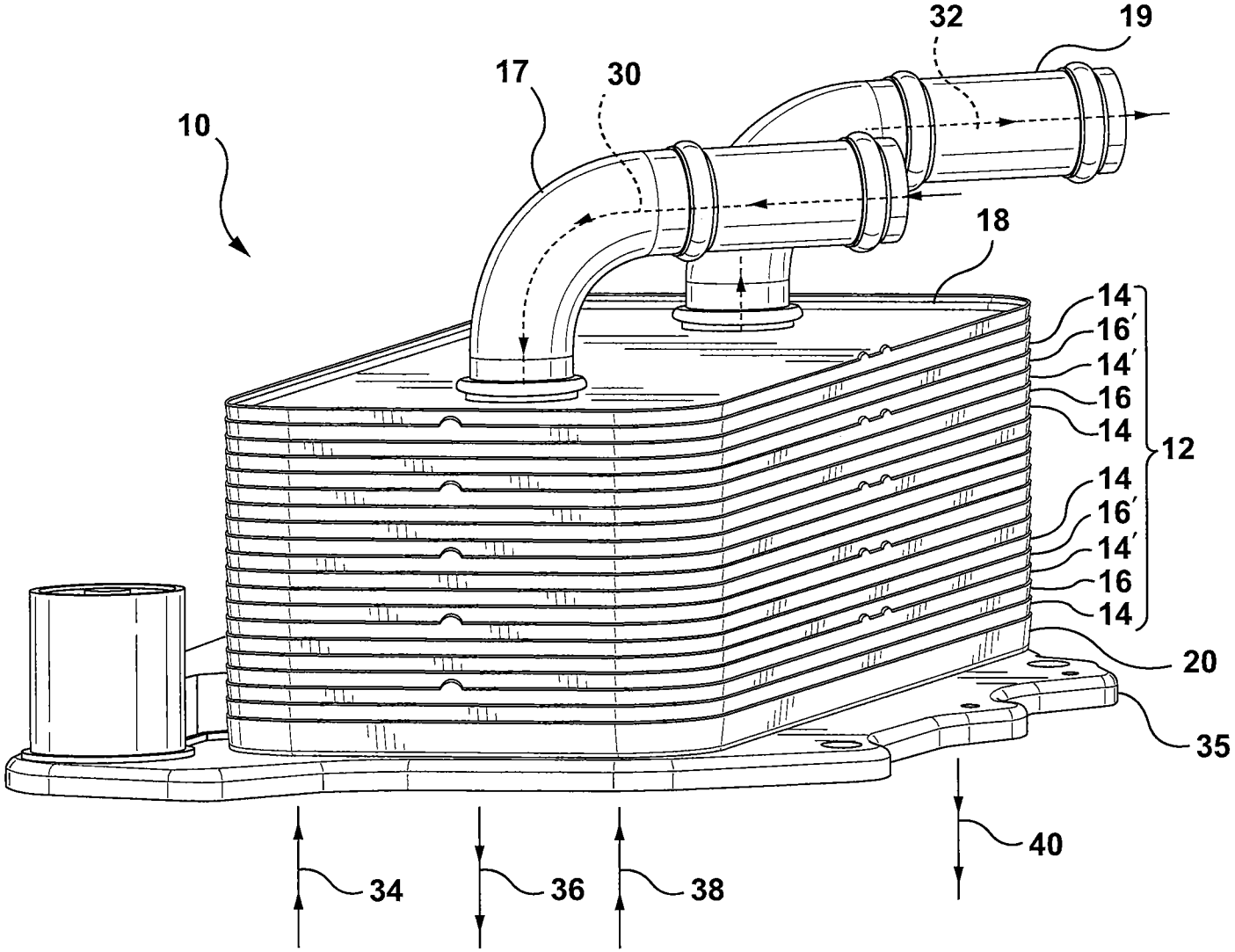
FIG. 1 is a perspective view of a heat exchanger according to an example embodiment of the present disclosure.
Figure 1A:
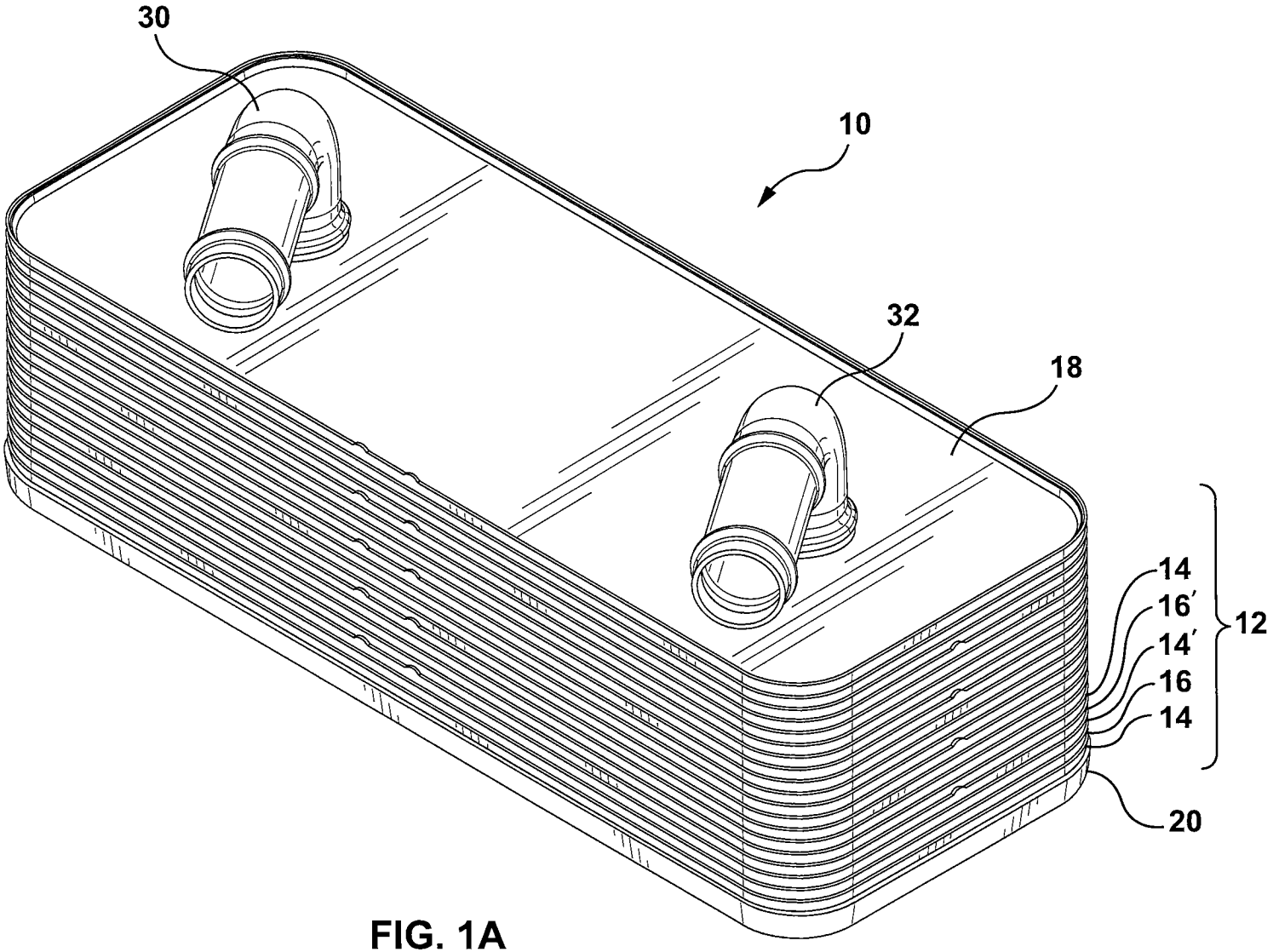
FIG. 1A is a perspective view of the heat exchanger of FIG. 1 without an attached mounting plate.

Terms such as "front", "rear", "side", "top", "bottom", "upper", "lower", etc., are used herein as terms of convenience, and do not indicate that the heat exchangers described herein are required to have any particular orientation in use.

Throughout the description and drawings, like reference numerals are used to identify like elements of the various embodiments described herein.

A heat exchanger according to an example embodiment of the present disclosure is now described with reference to FIGS. 1 to 7.

As shown in FIG. 1, heat exchanger 10 is in the form of a nested, dish-plate heat exchanger. Heat exchanger 10 comprises a heat exchanger core 12 that is comprised of a stack of a plurality of first and second heat exchanger plates 14, 16 disposed in alternating layers. The first and second heat exchanger plates 14, 16 are in the form of dish-shaped heat exchanger plates that nest together when arranged in a stack to form the heat exchanger core 12. The first and second heat exchanger plates 14, 16 are arranged within the heat exchanger core 12 such that each subsequent first heat exchanger plate 14 in the stack of plates forming the core 12 is rotated 180 degrees with respect to the previous first heat exchanger plate 14 in the stack. Similarly, each subsequent second heat exchanger plate 16 in the stack of plates is rotated 180 degrees with respect to the previous second heat exchanger plate 16 in the stack. Accordingly, the first and second heat exchanger plates 14, 16 each have a first orientation (first plate 14, second plate 16) and a second orientation (first plate 14', second plate 16') where the plates are rotated 180 degrees with respect to the plates that are disposed in the first orientations. Top and bottom end plates 18, 20 enclose the stack of first and second heat exchanger plates 14, 16 to form the heat exchanger 10, the top and bottom end plates providing fluid access ports for the various heat exchanger fluids entering and exiting the heat exchanger 10 as will be described in further detail below.

Figure 2:
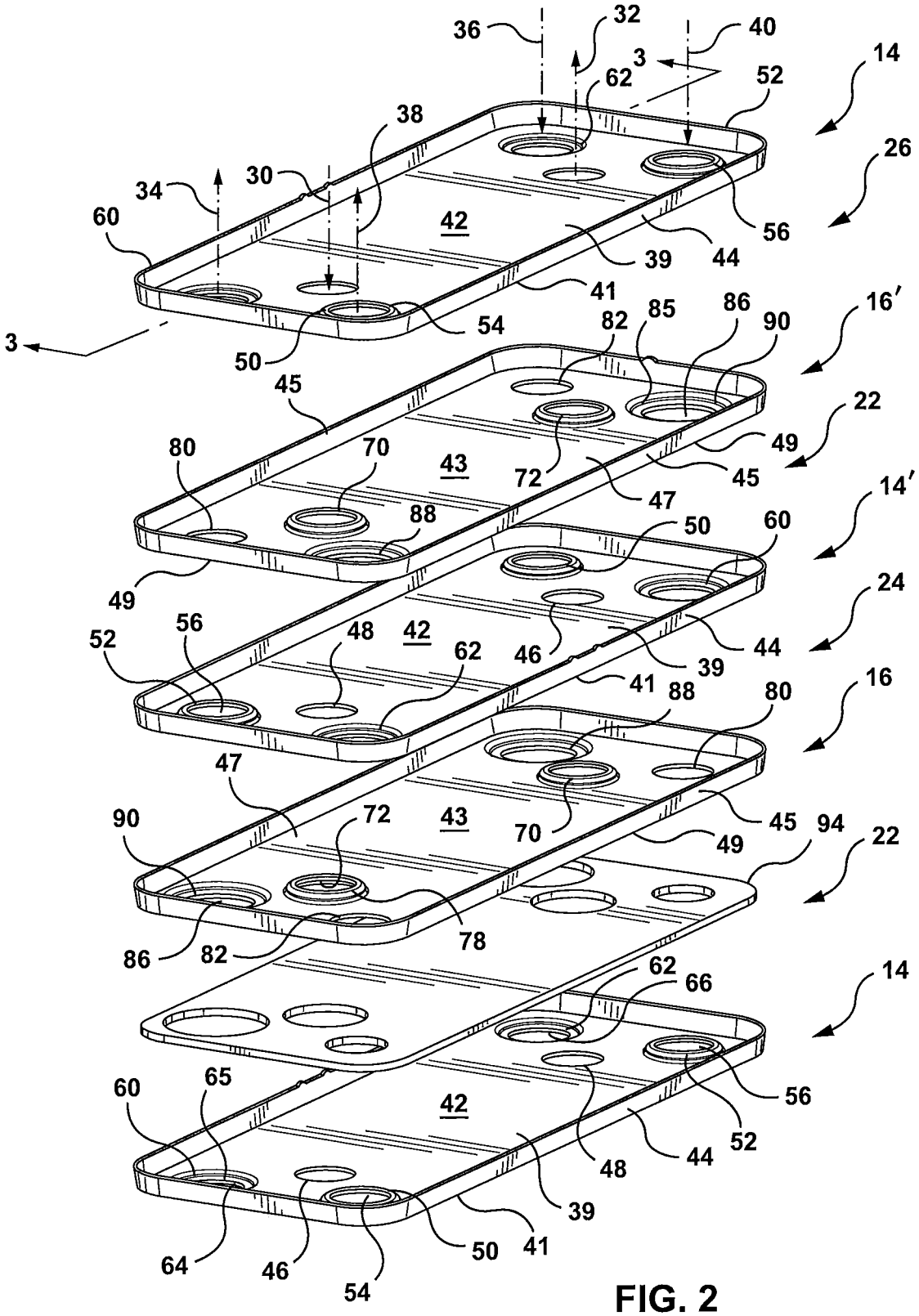
FIG. 2 is an exploded view of a portion of the heat exchanger core forming the heat exchanger of FIG. 1.
Figure 3:
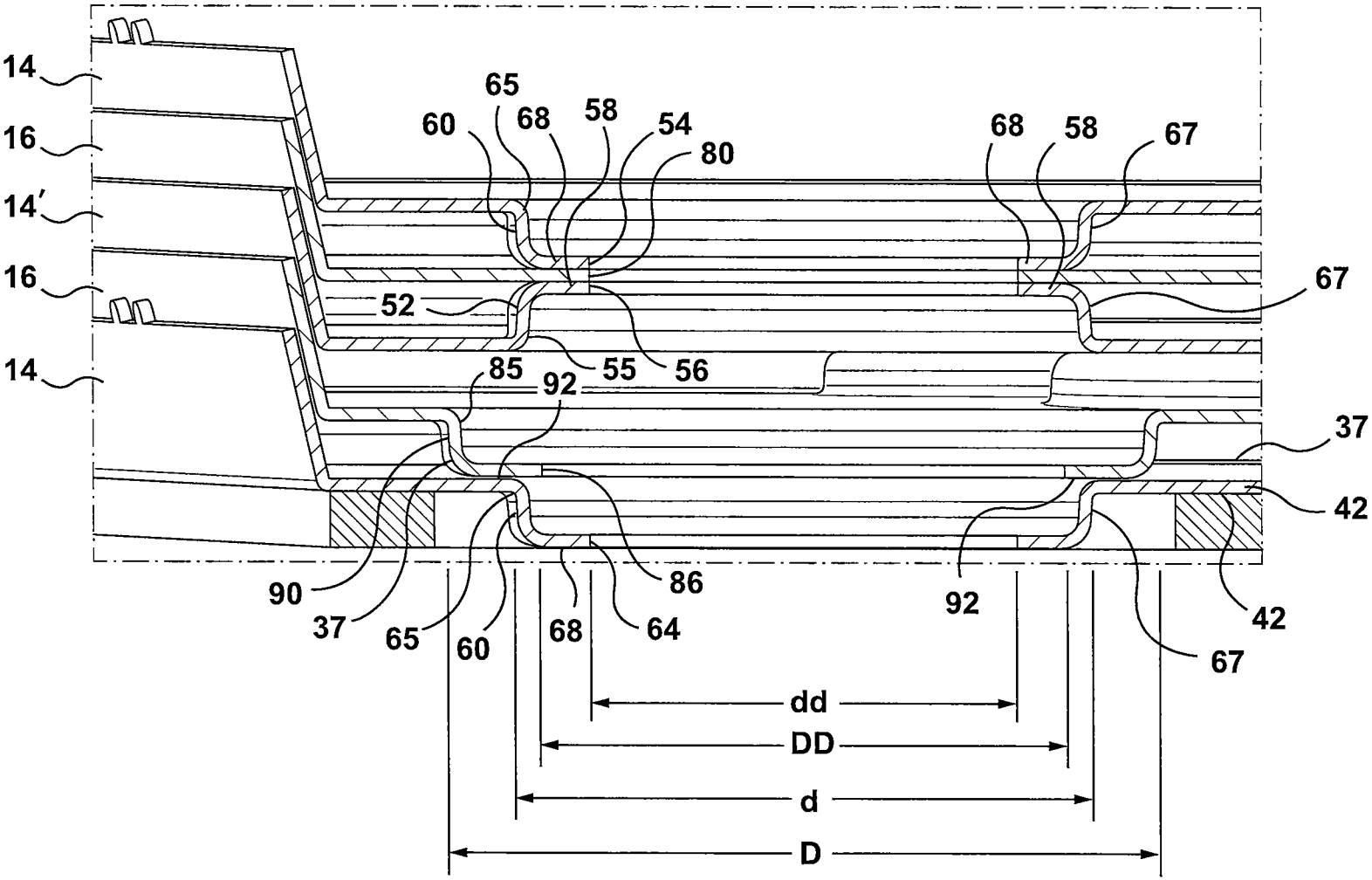
FIG. 3 is a detail cross sectional view one of the manifold regions of the heat exchanger taken along section line 3-3 shown in FIG. 2.

A set of first fluid flow passages 22 are formed between adjacent first and second plates 14, 16 when the adjacent first and second heat exchanger plates 14, 16 are both in either their first orientation 14, 16 or both in their second orientation 14', 16'. A set of second fluid flow passages 24 are formed between adjacent second heat exchanger plates 16 in their first orientation and first heat exchanger plates 14' in their second orientation. A set of third fluid flow passages 26 are formed between adjacent second heat exchanger plates 16' in their second orientation and first heat exchanger plates 14 in their first orientation. Accordingly, as illustrated in FIG. 2, when the first and second heat exchanger plates 14, 16 are arranged in alternating layers to form the heat exchanger core 12, the plates are arranged in the following pattern: first heat exchanger plate, first orientation 14; second heat exchanger plate, first orientation 16; first heat exchanger plate, second orientation 14'; second heat exchanger plate, second orientation 16'; first heat exchanger plate, first orientation 14, etc. As a result of the alternating pattern of first and second plates 14, 16, the various fluid flow passages formed between the layered first and second heat exchanger plates 14, 16, also alternate through the heat exchanger core 12 in a pattern of: first fluid flow passage 22, second fluid flow passage 24, first fluid flow passage 22, third fluid flow passage 26, first fluid flow passage 22, second fluid flow passage 24, first fluid flow passage 22, third fluid flow passage 26, first fluid flow passage 22, etc. Accordingly, the plurality of first fluid flow passages 22 are disposed in heat transfer relationship with both the plurality of second fluid flow passages 24 and the plurality of third fluid flow passages 26 while the plurality of second fluid flow passages 24 and the plurality of third fluid flow passages 26 are separated from each other or thermally isolated from each other by the plurality of first fluid flow passages 22.

The first set of fluid flow passages 22 are fluidly interconnected by a common inlet manifold and a common outlet manifold for the flow of a first fluid through the heat exchanger 10. Accordingly, for ease of reference, the inlet and outlet manifolds shared by and that fluidly interconnect the first set of fluid flow passages 22 will be referred to as a first inlet manifold 30 and a first outlet manifold 32. The first inlet manifold 30 and first outlet manifold 32 are illustrated schematically by example flow directional arrows in FIGS. 1 and 2 and, in the subject example embodiment, have corresponding inlet and outlet fittings 17, 19 mounted to the top end plate 18 of the heat exchanger 10 as shown in FIG. 1, the inlet and outlet fittings 17, 19 and the first inlet manifold 30 and the first outlet manifold 32 together providing for the inflow and outflow of a first heat exchange fluid through the heat exchanger 10. In some embodiments, for example, the first heat exchange fluid is a coolant stream. In the subject example embodiment, while the inlet and outlet fittings 17, 19 associated with the first inlet manifold 30 and first outlet manifold 32 are shown disposed at the top end of the heat exchanger such that they are mounted to the top end plate 18 of the heat exchanger 10, it will be understood that ,in some embodiments, the inlet and outlet fittings 17, 19 could also be arranged at the bottom end of the heat exchanger such that the inlet and outlet fittings 17, 19 are mounded to the base plate 35 of the heat exchanger 10 and that the illustration of the inlet and outlet fittings 17, 19 at the top end of the heat exchanger 10 is not intended to be limiting.

The second set of fluid flow passages 24 are fluidly interconnected by a second inlet manifold 34 and a second outlet manifold 36 for the flow of a second heat exchange fluid through the heat exchanger 10. The second inlet manifold 34 and second outlet manifold 36 are illustrated schematically by example flow directional arrows in FIG. 2. In the subject example embodiment, corresponding inlet and outlet openings or fittings are arranged on the bottom end plate 20 of the heat exchanger 10 (see FIG. 6) for the inflow and outflow of a second heat exchange fluid through the heat exchanger 10, for instance, transmission oil. In some embodiments, for example, the inlet and outlet openings or inlet and outlet fittings associated with the second heat exchange fluid, can be arranged at the top end or top end plate 18 of the heat exchanger 10.

The third set of fluid flow passages 26 are fluidly interconnected by a third inlet manifold 38 and a third outlet manifold 40 for the flow of a third heat exchange fluid through the heat exchanger 10. The third inlet manifold 38 and the fourth outlet manifold 40 are illustrated schematically by example flow directional arrows in FIG. 2. In the subject example embodiment, corresponding inlet and outlet openings or fittings are arranged on the bottom end plate 20 of the heat exchanger 10 (see FIG. 6) for the inflow and outflow of the third heat exchange fluid through the heat exchanger 10, for instance, a second source of transmission oil, or engine oil, or any other fluid within the automobile system requiring warming/cooling. In some embodiments, for example, the inlet and outlet openings or inlet and outlet fittings associated with the third heat exchange fluid, can be arranged at the top end or top end plate 18 of the heat exchanger 10.

In the subject example embodiment, the inlet and outlet fittings 17, 19 for the first set of manifolds 30, 32 are arranged on the top end plate 18 of the heat exchanger 10 while the inlet and outlet fittings or fluid mountings (not shown) for the second and third sets of manifolds are arranged on the bottom end plate 20. However, as set out above, it will be understood that the exact placement of the fittings associated with the first, second and third set of manifolds 30, 32, 34, 36, 38, 40 may vary depending upon a particular application and the desired location for specific fluid connections. Accordingly, the placement of the inlet and outlet fittings for the first set of manifolds 30, 32 on the top of the heat exchanger 10 and the placement of the inlet and outlet fittings for the second and third sets of manifolds 34, 36, 38, 40 on the bottom of the heat exchanger 10 is not intended to be limiting.

In some embodiments, for example, heat exchanger 10 may also be mounted on any suitable base plate or mounting plate 35 as shown in FIG. 1 wherein the mounting plate 35 incorporates appropriate fluid inlet and outlet fittings for supplying the second and third fluid flow passages with respective fluid streams by way of the second and third sets of inlet and outlet manifolds 34, 36 and 38, 40. Accordingly, reference to inlet and outlet fittings associated with corresponding inlet and outlet manifolds for any one of the first, second or third fluids flowing through the heat exchanger being mounted at the bottom end or in conjunction with the bottom end plate 20 of the heat exchanger 10 is also intended to include embodiments where the inlet and outlet fittings are mounted to the heat exchanger 10 via base plate 35. Therefore, it will be understood that various arrangements of fluid connections are contemplated within the scope of the present disclosure.

First and second heat exchanger plates 14, 16 that make up the heat exchanger core 12 will now be described in further detail with particular reference to FIGS. 2, 4 and 5.

As illustrated in FIG. 2, first and second heat exchanger plates 14, 16 each comprise a generally planar base portion 42, 43 that is surrounded by a peripheral edge wall 44, 45 that extends upwardly away from the generally planar base portion 42, 43 of the plates 14, 16. In some embodiments, for example, the peripheral edge wall 44, 45 of both the first and second plates 14, 16 is inclined or disposed at an angle relative to an axis that extends normal to the generally planar base portion 42, 43 of the first and second plates 14, 16. The generally planar base portion 42 of the first heat exchanger plate 14 has a top surface or inner surface 39 defined within the perimeter of the edge wall 44 and a bottom surface 41 that is opposite to the top or inner surface 39 of the first heat exchanger plate 14. Similarly, the generally planar base portion 43 of second heat exchanger plate 16 has a top or inner surface 47 defined within the perimeter of the edge wall 45 and a bottom surface 49 that is opposite to the top or inner surface 47 of the second heat exchanger plate 16. When the first and second heat exchanger plates 14, 16 are stacked one on top of the other, the edge wall 44 of first heat exchanger plate 14 overlaps with and seals against the edge wall 45 of the adjacent second heat exchanger plate 16. Similarly, the edge wall 45 of the second heat exchanger plate 16 overlaps with the edge wall 44 of the adjacent or subsequent first heat exchanger plate 14' that is disposed in its second orientation, with the overlapping pattern of peripheral edge walls continuing through the alternating stack of first and second heat exchanger plates 14, 16, 14', 16', etc. in their first and second orientations, the heat exchanger 10 therefore being in the form of a self-enclosing heat exchanger.

The first fluid flow passages 22 are defined between the top surfaces 39 of the first heat exchanger plates 14, 14' in both their first and second orientations and the bottom surfaces 49 of the adjacent second heat exchanger plates 16, 16' in both their first and second orientations. More specifically, the first fluid flow passages 22 are formed between adjacent first and second heat exchanger plates 14, 14', 16, 16' when the downwardly projecting boss portions 60, 62 of the first plates 14 are disposed to the same side of the central longitudinal axis of the heat exchanger 10 as the downwardly projecting boss portions 88, 90 of the second plates 16. The second fluid flow passages 24 are defined between the top surfaces 47 second heat exchanger plates 16 when in their first orientation and the bottom surface 41 of the first exchanger plates 14' when in their second orientation. The third fluid flow passages 26 are defined between the top surfaces 47 of the second heat exchanger plates 16' in their second orientation and the bottom surface 41 of the first heat exchanger plates 14 in their first orientation. Accordingly, the second fluid flow passages 24 are formed between adjacent first and second heat exchanger plates 14, 16 when the downwardly projecting boss portions 88, 90 of the second plates 16 are disposed to the same side of the central longitudinal axis of the heat exchanger 10 as the upwardly projecting boss portions 50, 52 of the first plates 14, which in the example embodiment shown in FIG. 2, is the rear or back side of the heat exchanger 10 or the left side of the central longitudinal axis of the heat exchanger 10, while the third fluid flow passages 26 are formed between adjacent first and second heat exchanger plates 14, 16 when the downwardly projecting boss portions 88, 90 of the second plates 16 and the upwardly projecting boss portions 50, 52 of the first plates 14 are disposed to the same, opposite side of the central longitudinal axis of the heat exchanger as compared to the arrangement for the second fluid flow passages 24. Accordingly, in this example embodiment, the third fluid flow passages 26 are formed between adjacent first and second heat exchanger plates 14, 16 when the downwardly projecting boss portions 88, 90 of the second plates 16 and the upwardly projecting boss portions 50, 52 of the first plates 14 are both disposed to the front side of the heat exchanger or to the right side of the central longitudinal axis of the heat exchanger 10.

Figure 4:
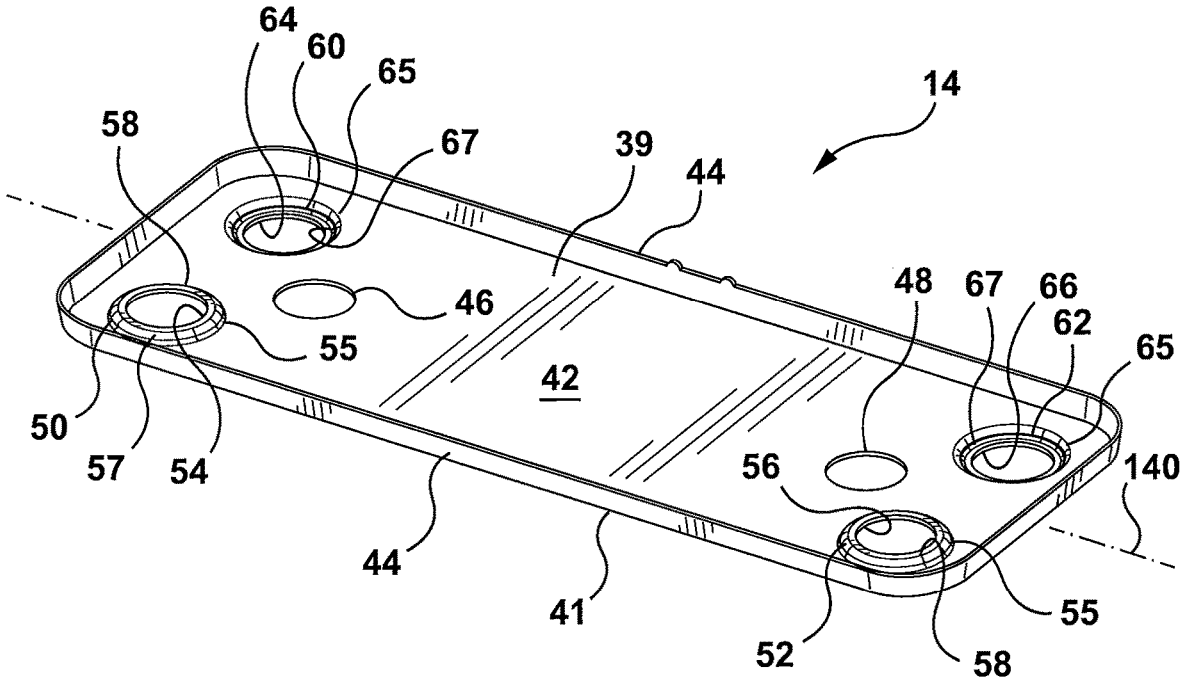
FIG. 4 is top perspective view of one of the first heat exchanger plates forming the heat exchanger of FIG. 1.

Referring now FIG. 4 and to first heat exchanger plates 14, a pair of first fluid openings 46, 48 are formed in each of the first plates 14. The openings 46, 48 are formed within the planar surface of the base portion 42 of the first plates 14 at opposite ends thereof and are arranged so as to be generally in line with one another and spaced apart from each other along the central longitudinal axis 140 of the first plates 14. It will be understood that when the first heat exchanger plates 14 are disposed in the stack of heat exchanger plates to form the heat exchanger core 12 that the central longitudinal axis of the first heat exchanger plates 14 will generally correspond to the central longitudinal axis of the heat exchanger 10.

A first pair of boss portions or embossments 50, 52 are formed in each of the first plates 14 spaced apart from each other at opposite ends of the first plate 14, 14'. The boss portions or embossments 50, 52 project upwardly from the top surface 39 of the base portion 42 out of the plane of the base portion 42 of the first plates 14. The boss portions 50, 52 are formed so as to be generally in line with one another along the length of or along an axis parallel to, or substantially parallel to, the central longitudinal axis 140 of the first plates 14 but disposed to one side of the central longitudinal axis 140 of the first plate 14. An opening 54, 56 is formed in each of the boss portions 50, 52 such that a contact surface or sealing surface in the form of a peripheral flange 58 surrounds each of openings 54, 56 in bosses 50, 52. A corresponding opening or depression 55 is formed on the underside of each of the boss portions 50, 52 visible from the bottom surface 41 of the base portion 42 of the first heat exchanger plate 14 which boss portion base opening or depression 55 generally corresponds to the diameter d of the base of the boss portions 50, 52. The opening or base of the boss portion 55 being slightly larger than the openings 54, 56 formed in the upper surface of the boss portions 50, 52, the boss portions 50, 52 therefore being defined by sidewall 57 that extends from opening 55 to the peripheral flange 58. Accordingly, the first pair of boss portions 50, 52 define contact or sealing surfaces in the form of peripheral flange 58 that are disposed in a first plate first sealing surface plane that is disposed above the plane of the central generally planar base portion 42 of the first plate 14, 14' and that extends parallel to, or substantially parallel to, the plane of the central generally planar base portion 42 of the first plate 14, 14'.

A second pair of boss portions or embossments 60, 62 is formed in each of the first plates 14, 14' spaced apart from each other at opposite ends of the first plate 14, 14'. The second pair of boss portions or embossments 60, 62 project downwardly out of the plane of the base portion 42 of the first plates 14 from the bottom surface 41 thereof. Accordingly, the second pair of boss portions 60, 62 are oppositely disposed with respect to the first pair of boss portions 50, 52 relative to the base portion 42 of the first plates 14, 14'. Boss portions 60, 62 are also arranged on the opposite side of the central, longitudinal axis 140 of the first heat exchanger plates 14, 14' as the first pair of boss portions 50, 52 and are arranged such that the boss portions 60, 62 are disposed generally in line with one another along the length of or along an axis parallel to, or substantially parallel to, the central longitudinal axis 140 of the first plates 14, 14' but which axis is disposed to the other side of the central longitudinal axis 140 as the first pair of boss portions 50, 52. An opening 64, 66 is formed in each of the bosses 60, 62 such that a contact surface or sealing surface in the form of a peripheral flange 68 surrounds each of the openings 64, 66 in boss portions 60, 62. A corresponding boss portion base opening or depression 65 is formed in the top surface 39 of the base portion 42 of the first heat exchanger plate 14 that corresponds to the diameter of the base of the boss portions 60, 62. The boss portions 60, 62 are therefore defined by a sidewall 67 that extends from the boss portion base opening or base 65 to the peripheral flange 68. Accordingly, the second pair of boss portions 60, 22 define contact or sealing surfaces in the form of peripheral flange 68 that are disposed in a first plate second sealing surface plane that is disposed below the plane of the central, generally planar base portion 42 of the first plate 14, 14' and that extends parallel to, or substantially parallel to, the plane of the central, generally planar base portion 42 of the first plate 14, 14'. Accordingly, each first heat exchanger plate 14 includes a first pair of fluid openings disposed within the plane of the base portion 42 of the plate 14, a second pair of fluid openings disposed in a first plate first sealing surface plane that is disposed above and generally parallel to the base portion 42, and a third pair of fluid openings disposed in a first plate second sealing plane that is disposed below and generally parallel to the base portion 42 of the first heat exchanger plates 14.

In the subject example embodiment, all of the openings 46, 48, 54, 56, 64, 66 formed in the first heat exchanger plates 14 have generally the same shape and size, and, in the subject example embodiment are all circular openings having the same diameter. The peripheral flanges 58 associated with openings 50, 52 also have the same size as the peripheral flange 68 associated with openings 64, 66.

When the first heat exchanger plates 14 are arranged in their first orientation, the openings 54, 56 formed in upwardly projecting boss portions 50, 52 are all arranged to one side of the central longitudinal axis 140 of the plates 14 while the openings 64, 66 formed in the downwardly projecting boss portions 60, 62 are arranged on the other, opposite side of the central longitudinal axis 140 of the first plates 14. For example, in the example embodiment illustrated in FIG. 2, the openings 54, 56 formed in raised boss portions 50, 52 are disposed towards the illustrated front side of the heat exchanger 10 (or to the right of the longitudinal axis 140 of plates 14), while the openings 64, 66 formed in the downwardly projecting boss portions 60, 62 are disposed towards the illustrated rear side of the heat exchanger 10 (or to the left of the longitudinal axis 140 of plates 14). When the first heat exchanger plates 14 are arranged in their second orientation 14', the location of the upwardly projecting boss portions 50, 52 with openings 54, 56 and the downwardly projecting boss portions 60, 62 with openings 64, 66 are reversed as the first plates 14 have been rotated 180 degrees about an axis that extends normal to the central longitudinal axis of the first plates 14. Therefore, in the example embodiment illustrated in FIG. 2, when the first heat exchanger plates are in their second orientation 14', the openings 54, 56 formed in raised boss portions 50, 52 are disposed towards the illustrated rear side of the heat exchanger 10 (or to the left of the longitudinal axis 140 of plates 14'), while the openings 64, 66 formed in the downwardly projecting boss portions 60, 62 are disposed towards the illustrated front side of the heat exchanger 10 (or to the right of the longitudinal axis 140 of plates 14').

Figure 5:
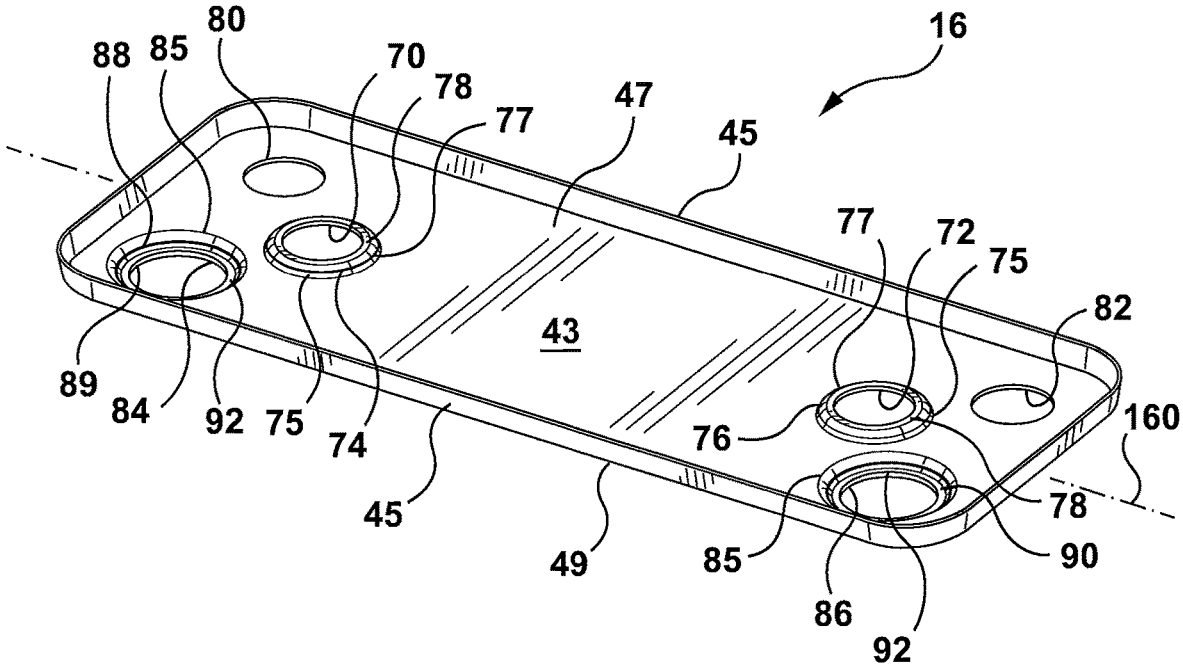
FIG. 5 is a top perspective view of one of the second heat exchanger plates forming the heat exchanger of FIG. 1.

Referring now to FIG. 5 and to second heat exchanger plates 16, a pair of first fluid openings 70, 72 is formed in each of the second plates 16 at opposite ends thereof, the openings 70, 72 being arranged so as to be spaced apart from each other and generally in line with one another along the central, longitudinal axis 160 of the second plates 16. Openings 70, 72 are formed in a first set of corresponding boss portions or embossments 74, 76 that project upwardly out of the plane of the top surface 37 of base portion 43 of the second plates 16, 16'. A peripheral flange 78 surrounds each of openings 70, 72 in boss portions 74, 76 and serves as a contact or sealing surface that is disposed in a second plate first sealing surface plane that extends parallel to, or substantially parallel to, the base portion 43 of the second plates 16, 16' and that is disposed above the plane of the base portion 43 of the second plates 16, 16'. The first pair of openings 70, 72 in second plates 16 are sized so as to correspond to the size of the first pair of openings 46, 48 formed in first heat exchanger plates 14, 14'. Accordingly, the openings 46, 48 that are formed within the generally planar base portion 42 of the first plates 14, 14' and arranged along the central longitudinal axis 140 of the first heat exchanger plates 14 have the same diameter as the openings 70, 72 formed in the first set of boss portions 74, 76 formed along the central longitudinal axis 160 of the second plates 16, 16'. A corresponding boss portion base opening or depression 75 is formed by the underside of boss portions 74, 76 visible in the bottom surface 47 of the base portion 43 of the second heat exchanger plates 16. The boss portion base opening 75 corresponds to the base of the boss portions 74, 76, the boss portions 74, 76 therefore being defined by a sidewall 77 that extends between the opening or base 75 of the boss portions 74, 76 to the peripheral flange 78 that surrounds openings 70, 72.

A second pair of openings 80, 82 is formed in the base portion 43 of each of the second plates 16 at opposite ends thereof and generally in line with one another along the length of the second plates 16 or along an axis that extends parallel to, or substantially parallel to, the central longitudinal axis 160 of the second plates 16, 16' but disposed to one side of the central longitudinal axis 160 of the second plate 160. The openings 80, 82 are formed within the surface of the base portion 43 of the second plates 16.

A third pair of openings 84, 86 is formed in each of the second plates 16, 16' at opposite ends of the second plates 16 and arranged generally in line with one another along an axis that extends parallel to, or substantially parallel to, the central longitudinal axis 160 of the second plates 16, 16' but disposed on the opposite side of the central longitudinal axis 160 of the second plates 16, 16' as the openings 80, 82 formed within the plane of the base portion 43 of the second plates 16, 16'. Openings 84, 86 are formed in a second set of corresponding boss portions or embossments 88, 90 that project downwardly out of the plane of the base portion 43 of the second plates 16, 16'. Accordingly, the boss portions 88, 90 associated with the third pair of openings 84, 86 are oppositely disposed with respect to or relative to the boss portions 74, 76 associated with the first pair of openings 70, 72 of the second plates 16, 16'. A peripheral flange 92 surrounds each of the openings 84, 86 formed in the second set of corresponding boss portions 88, 90. Accordingly, peripheral flange 92 serves as a sealing surface or contact surface that is disposed in a second plate second sealing surface plane that is disposed below the plane of the base portion 43 of the second plate 16, 16' and that extends parallel to, or substantially parallel to, the plane of the base portion 43 of the second plates 16, 16'. A corresponding opening 85 is formed by each of the boss portions 88, 90 which opening 85 is disposed on the inner surface 47 of the base portion 43 of the second heat exchanger plates 16, the opening 85 corresponding to the base of the boss portions 88, 90. The boss portions 88, 90 are, therefore, defined by a sidewall 87 that extends from the opening or base 85 to the peripheral flange 92. The downwardly projecting boss portions 88, 90 associated with openings 84, 86 in the second plates 16 are formed so as to be larger than the upwardly projecting boss portions 74, 76 associated with the first pair of openings 70, 72. The boss portions 88, 90 associated with the third pair of openings 84, 86 in the second plates 16 have a diameter D that is larger than the diameter of both sets of boss portions 50, 52 and 60, 62 formed in the first heat exchanger plates 14, 14'. Accordingly, the openings 85 associated with the base of the boss portions 88, 90 are larger in diameter than the openings 75, 65, 55 associated with the base of the boss portions 74, 76, 50, 52, and 60, 62. The openings 84, 86 formed in boss portions 88, 90 and surrounded by peripheral flange 92 also have a larger diameter DD than the diameter dd of all of the other openings formed in the first and second plates 14, 16. The contact surface or peripheral flange 92 associated with openings 84, 86 also being larger than the contact surface or peripheral flanges 58, 68 associated with openings 54, 56 in bosses 50, 52 and openings 64, 66 in bosses 60, 62 of the first heat exchanger plates 16.

When the second heat exchanger plates 16 are arranged in their first orientation, the second pair of openings 80, 82 formed in the base portion 43 of the second plates 16 are all arranged to one side of the central longitudinal axis 160 of the plates 16. For example, in the example embodiment illustrated in FIG. 2, when the second heat exchanger plates 16 are disposed in their first orientation the second pair of openings 80, 82 are all disposed towards the illustrated front side of the heat exchanger 10 (or to the right of the central, longitudinal axis 160 of the second plates 16) while the third pair of openings 84, 86 formed in downwardly protruding boss portions 88, 90 are disposed towards the illustrated rear side of the heat exchanger 10 (or to the left of the central, longitudinal axis 160 of second plates 16). When the second heat exchanger plate 16' is arranged in its second orientation rotated 180 degrees relative to the first orientation of the second plate 16 about an axis that is normal to the plane of the base portion 43 of the second plate 16', the second pair of openings 80, 82 disposed within the plane of the base portion 43 of the second plates 16' are all disposed towards the illustrated rear side of the heat exchanger 10 (or to the left of the central longitudinal axis 160 of second plates 16') while the third pair of openings 84, 86 formed in downwardly protruding boss portions 88, 90 are disposed towards the illustrated front side of the heat exchanger 10 (or to the right of the central longitudinal axis 160 of plates 16').

While the terms "front" and "rear" have been used in reference to the view illustrated in FIG. 2, as set out above, it will be understood that these terms are used as terms of convenience and are not intended to limit the specific orientation of the heat exchanger 10. The terms "front" and "rear" have been used to distinguish between the placement of the upwardly and downwardly projecting bosses in connection with the first and second orientations of the first and second heat exchanger plates 14, 16, 14', 16' with respect to the central longitudinal axes 140, 160 of the heat exchanger plates 14, 16.

Figure 5A:
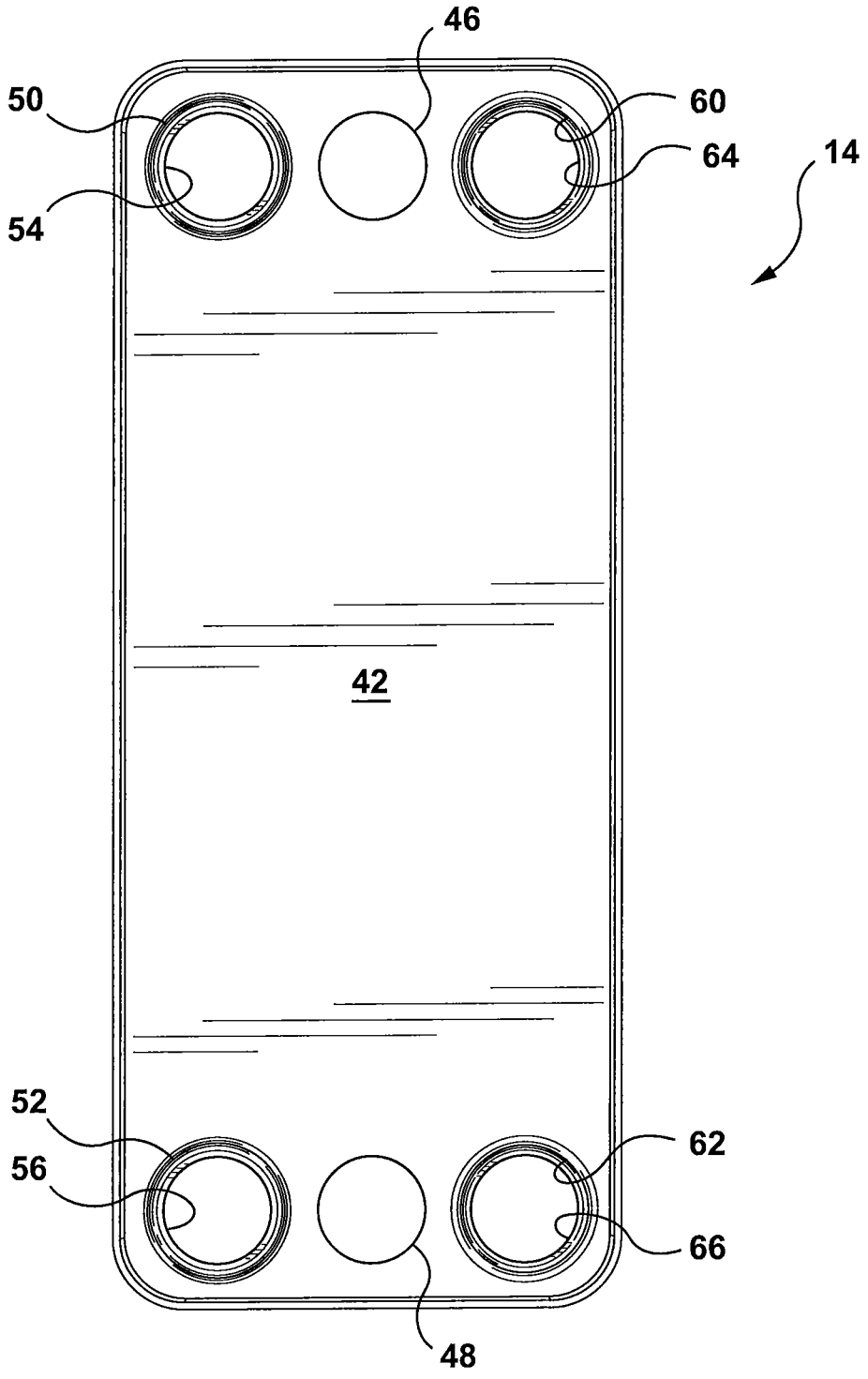
FIG. 5A is a top plan view of an alternate embodiment of a first heat exchanger plate for forming the heat exchanger core.

In the subject example embodiment, with reference to FIGS. 4 and 5, for example, the first pair of openings 46, 48 formed in first plates 14 and the first pair of openings 70, 72 formed in the second plates 16 are inwardly disposed or inset from the respective ends or end edges of the heat exchanger plates 14, 16 along the central longitudinal axis of the plates 140, 160. The first pair of openings 46, 48 formed in first plates 14 and the first pair of openings 70, 72 formed in the second plates 16 are also inwardly disposed or inset relative to the other openings 54, 64, 82, 86 and 56, 66, 80, 84 that are also formed at the respective ends of first and second plates 14, 16. As well, the second and third pairs of openings 54, 56 and 64, 66 formed in boss portions 50, 52 and 60, 62 of the first plates 14 and the second and third pairs of openings 80, 82 and 84, 86 (in boss portions 88, 90) are each arranged so as to be proximal a respective corner of the corresponding first or second heat exchanger plate 14, 16. However, it will be understood that in other example embodiments, the first pairs of openings 46, 48 and 70, 72 may be formed so that they are generally in line with the other openings 54, 56 and 64, 66 formed in first plates 14 and the other openings 80, 82 and 84, 86 formed in second plates 16 across the width of the corresponding first or second heat exchanger plate 14, 16 as schematically illustrated, for example, with reference to a first heat exchanger plate 14 in FIG. 5A. While the first heat exchanger plate 14 has been illustrated in FIG. 5A with all of the openings at the ends of the heat exchanger plate 14 being aligned with one another across the width or along an axis that extends transverse to the central longitudinal axis 140 of the plate 14, it will be understood that in such an example embodiment, the openings in the second heat exchanger plates 16, 16' would be similarly disposed so as to correspond to the openings provided in the first heat exchanger plates 14, 14', as shown for instance in FIG. 5C.

Figure 5B:
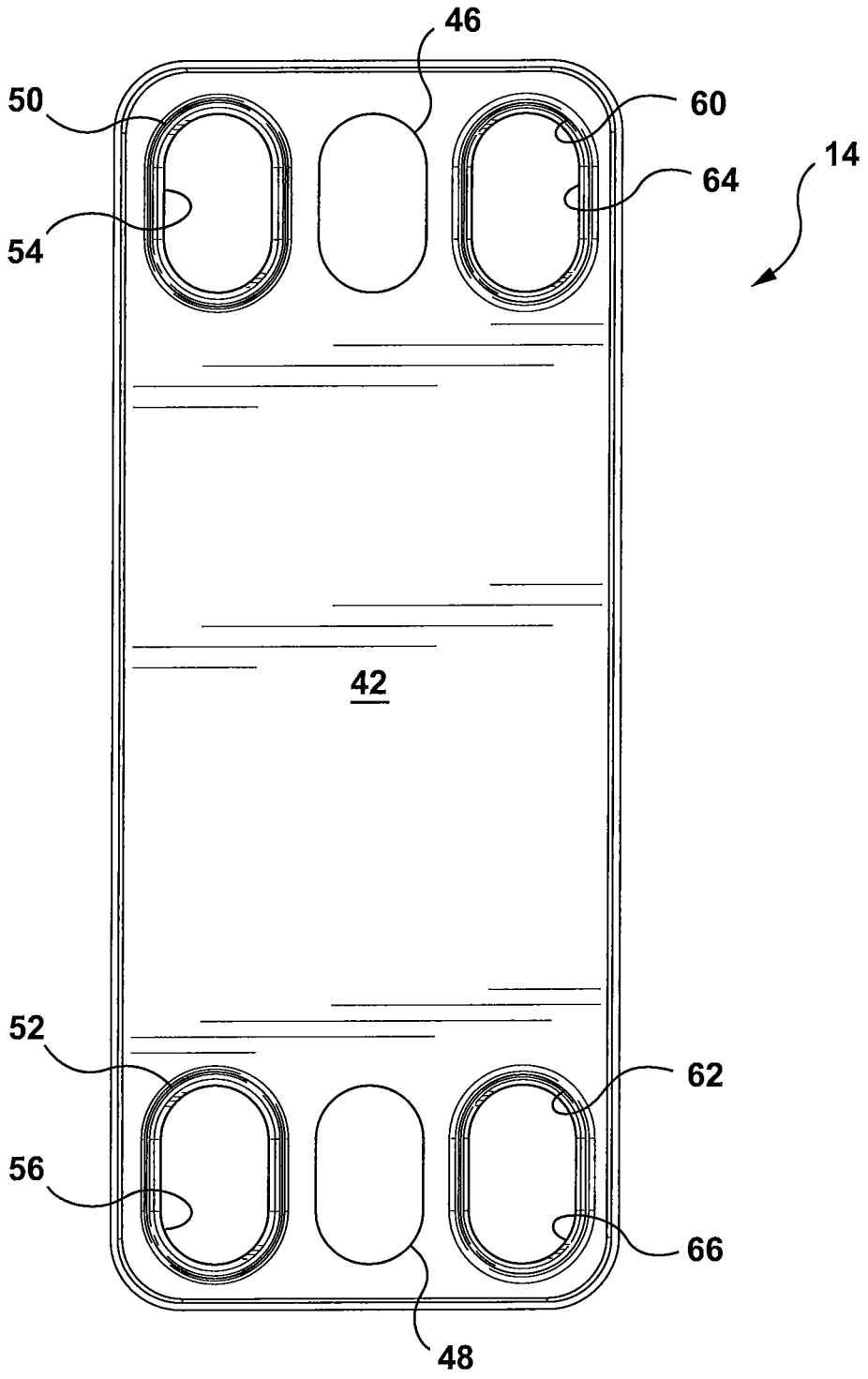
FIG. 5B is a top plan view of an alternate embodiment of an example first heat exchanger plate for forming the heat exchanger core.
Figure 5C:
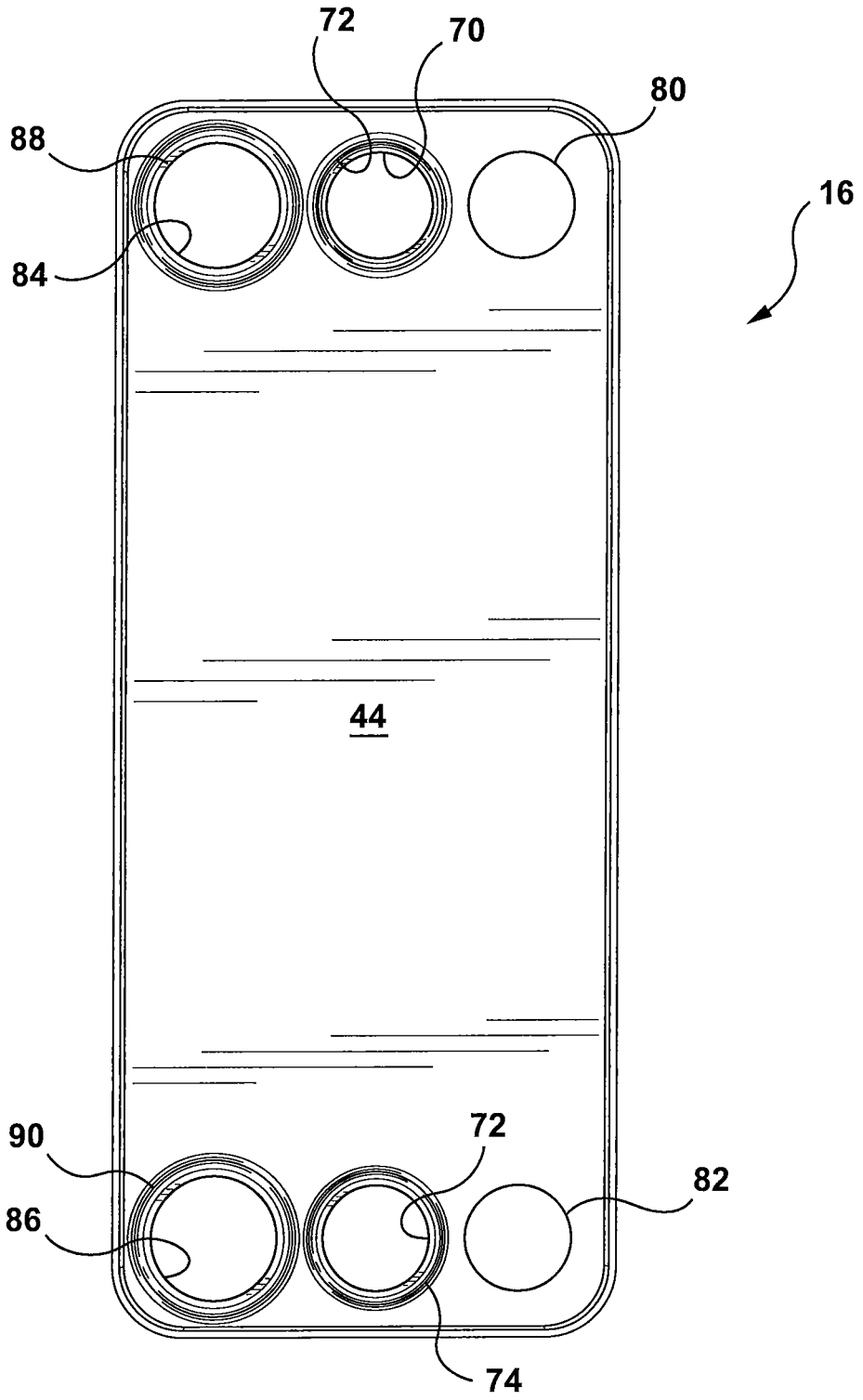
FIG. 5C is a top plan view of an alternate embodiment of a second heat exchanger plate for forming the heat exchanger core corresponding to the embodiment of the first heat exchanger plate of FIG. 5A.
Figure 5D:
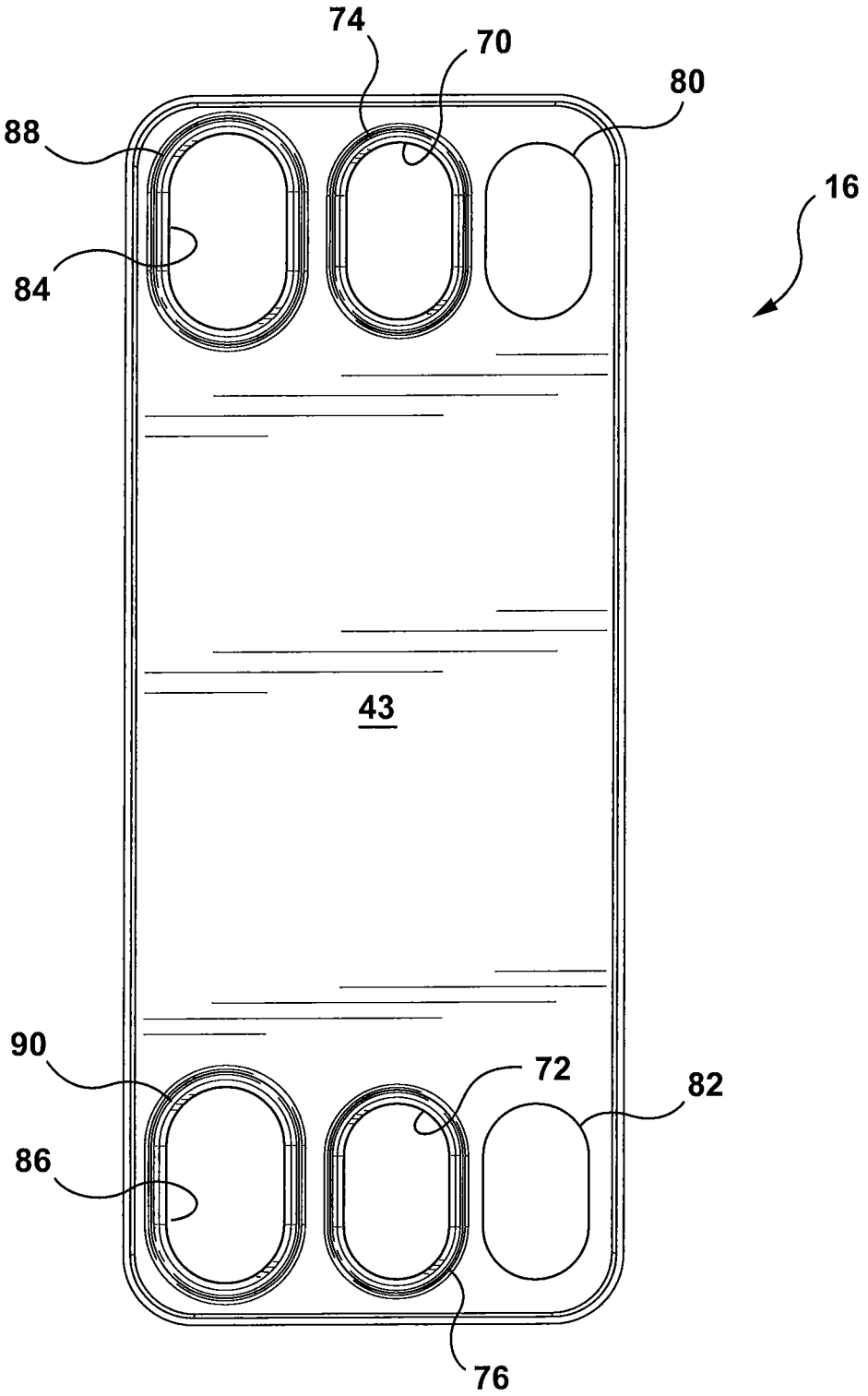
FIG. 5D is a top plan view of an alternate embodiment of a second heat exchanger plate for forming the heat exchanger core corresponding to the embodiment of the first heat exchanger plate of FIG. 5B.

Furthermore, while the three pairs of openings and the related boss portions in the first and second plates 14, 16 have been shown as being circular, it will be understood that they may have other shapes and that not all pairs of openings need to have the same shape. Other possible shapes of openings include oblong or slightly rectangular, square, oval, etc. An example embodiment of a first heat exchanger plate 14 have generally oblong shaped openings is illustrated in FIG. 5B. While the first heat exchanger plate 14 has been illustrated in FIG. 5B as having generally oblong shaped openings, it will be understood that in such an example embodiment, the openings in the second heat exchanger plates 16, 16' would be similarly shaped so as to correspond to the openings provided in the first heat exchanger plates 14, 14' as shown, for example, in FIG. 5D.

The stacking arrangement of the first and second plates 14, 16 is described in further detail with particular reference being made to FIG. 2.

As set out above, the heat exchanger core 12 is comprised of plurality of first and second heat exchanger plates 14, 16 that are arranged generally parallel to one another and are stacked one on top of the other in alternating layers such that the edge wall 44, 45 of either the first heat exchanger plate 14 or the second heat exchanger plate 16 overlaps with the edge wall 44, 45 of the adjacent first or second heat exchanger plate 14, 16. As well, as the first and second plates 14, 16 are arranged in their alternating layers, each subsequent first heat exchanger plate 14' is rotated 180 degrees with respect to the previous first heat exchanger plate 14 in the stack. Similarly, each subsequent second heat exchanger plate 16' is rotated 180 degrees with respect to the previous second heat exchanger plate 16. Therefore, in order to form heat exchanger core 12, a first heat exchanger plate 14 is arranged in its first orientation with the upwardly projecting boss portions 50, 52 arranged towards one side of the central longitudinal axis of the heat exchanger plate 14 and with the downwardly projecting boss portions 60, 62 arranged towards the other side of the central longitudinal axis of the heat exchanger plate 14.

A second heat exchanger plate 16, in its first orientation, is stacked on top of the first heat exchanger plate 14 with the edge wall 45 of the second heat exchanger plate 16 nesting within and against the edge wall 44 of the first heat exchanger plate 14. In the subject example embodiments, the sloping nature of the edge walls 44, 45 of the first and second plates 14, 16 helps to ensure that the top surface 39 of the base portion 42 of the first plate 14 remains spaced apart from the bottom surface 49 of the adjacent second plate 16 when the plates 14, 16 are stacked together, the first flow passages 22 being formed in this space. In its first orientation, the second heat exchanger plate 16 is stacked on top of the first heat exchanger plate 14 so that the downwardly projecting boss portions 88, 90 are arranged on the same side of the central longitudinal axis of the heat exchanger 10 as the downwardly projecting boss portions 60, 62 of the first heat exchanger plate 14. Therefore, in the example embodiment shown in FIG. 2, the downwardly projecting boss portions 88, 90 of the second plate 16 are arranged towards the rear of the heat exchanger 10 with the planar openings 80, 82 being arranged towards the front side of the heat exchanger 10. Therefore, when the second plate 16 in its first orientation is stacked on top of the first heat exchanger plate 14 in its first orientation, the contact surface or peripheral flange 58 surrounding the openings 54, 56 formed in the upwardly projecting bosses 50, 52 of the first heat exchanger plate 14 come into contact with the bottom surface 49 of the base portion 43 second heat exchanger plate 16 that surrounds the planar, second pair of openings 80, 82 that are formed in the base portion 43 of the second heat exchanger plate 16. As well, the contact surface or peripheral flange 92 associated with the larger, third pair of openings 84, 86 formed in the downwardly projecting boss portions 88, 90 that project out from the bottom or outer surface 49 of the base portion 43 of the second heat exchanger plate 16 come into contact with the inner surface of the base portion 42 of the first heat exchanger plate 14 that surrounds the opening or depression 65 formed by the downwardly projecting boss portions 60, 62 formed in the first heat exchanger plate 14. As a result of the larger sized boss portions 88, 90 formed in the second heat exchanger plate 16, the peripheral flange 92 surrounding the openings 84, 86 is able to contact and seal against the top surface 39 of the base portion 42 of the first plate 14 that surrounds the opening or depression 65 formed in the first heat exchanger plate 14. The contact between the upwardly projecting boss portions 54, 56 of the first plate 14 against the outer surface 49 of the base portion 43 of the second plate 16 and the contact between the downwardly projecting boss portions 88, 90 of the second heat exchanger plate 16 and the inner surface 39 of the base portion 42 of the first heat exchanger plate 14 helps to space the adjacent first and second plates 14, 16 away from each other thereby forming the first fluid flow passages 22 therebetween and fluidly isolating or sealing the first fluid flow passages 22 from the second and third fluid flow passages 24, 26.

Figure 8:
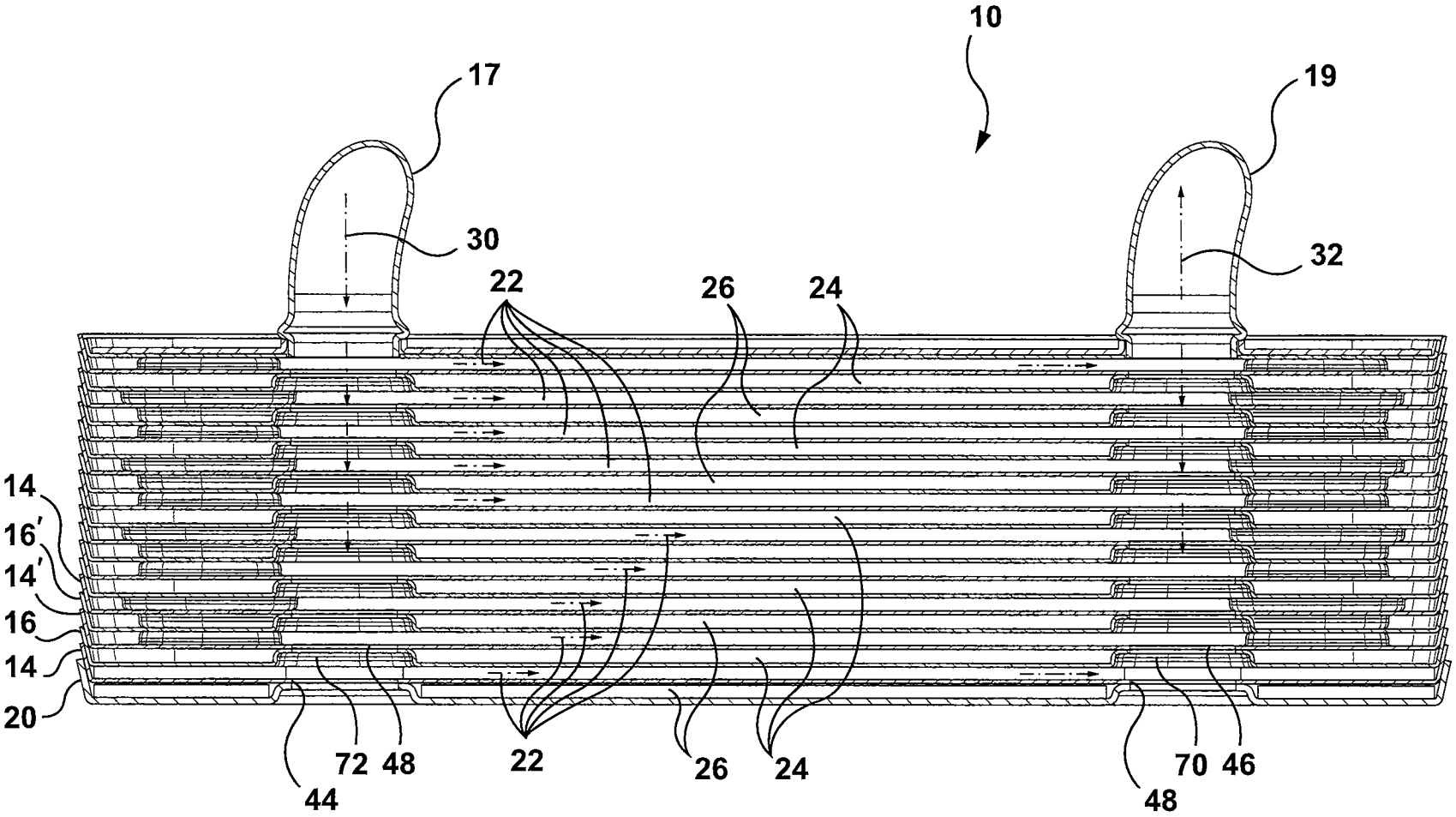
FIG. 8 is a cross-sectional view of the heat exchanger of FIG. 1 through the first set of manifolds.

While the first set of openings 46, 48 formed in the base portion 42 of the first plate 14 are vertically aligned with the first set of openings 70, 72 formed in the adjacent second heat exchanger plate 16 when the first heat exchanger plate 14 and the second heat exchanger plate 16 are stacked together, the first set of openings 46, 48 in the first heat exchanger plate 14 remain spaced apart from the bottom surface 49 of the base portion 43 of the second plate 16 and from openings 70, 72 formed in the upwardly projection boss portions 74, 76 of the second heat exchanger plate 16. Accordingly, fluid entering/exiting the heat exchanger 10 through the first inlet manifold 30 and first outlet manifold 32 which are fluidly interconnected to the corresponding aligned set of first fluid openings 46, 48, 70, 72 formed in the first and second heat exchanger plates 14, 16 is able to flow through the first fluid flow passages 22 formed in the space between the inner surface 39 of the base portion 42 of the first heat exchanger plate 14 (whether in its first orientation or second orientation) and the outer surface 49 of the base portion 43 of the adjacent second heat exchanger plate 16 (whether in its second orientation) since openings 70, 72 in the second heat exchanger plate 16 remain spaced apart from openings 46, 48 in the first heat exchanger plate 14. FIG. 8 illustrates a cross-sectional view of the heat exchanger 10 through the central, longitudinal axis of the heat exchanger 10 where the openings 46, 48 formed in the first plates 14 and the corresponding openings 70, 72 formed in the second plates 16 align so as to form the first inlet and first outlet manifold 30, 32 for inletting and discharging a first heat exchange fluid to and from first fluid flow passages 22.

The next plate in the stack of heat exchanger plates illustrated in FIG. 2 is a first heat exchanger plate 14' disposed in its second orientation. Accordingly, the second, first heat exchanger plate 14' arranged in the stack of heat exchanger plates is rotated 180 degrees with respect to the previously described first heat exchanger plate 14 about an axis normal to the plane of the base portion 42 of the first heat exchanger plate 14. Therefore, in the example embodiment shown in FIG. 2, when the first heat exchanger plate 14' is in its second orientation, the downwardly projecting boss portions 60, 62 are arranged towards the front side of the heat exchanger 10 (or to the right of the longitudinal axis 140 of the heat exchanger plate 14') with the upwardly projecting boss portions 50, 52 being arranged toward the rear of the heat exchanger 10 (or to the left of the longitudinal axis 140 of the first heat exchanger plate 14'). Accordingly, the arrangement of upwardly projection bosses and downwardly projecting bosses in the first heat exchanger plate 14' when disposed in its second orientation is generally opposite to the arrangement of upwardly projection bosses and downwardly projecting bosses in the first heat exchanger plate 14 when disposed in its first orientation. When the first heat exchanger plate 14' in its second orientation is arranged on top of a second heat exchanger plate 16 in its first orientation, the peripheral flange 78 that surrounds the first pair of openings 70, 72 formed in the upwardly projecting boss potions 74, 76 of the second heat exchanger plate 16 contacts and seals against bottom surface 41 of the base portion 42 of the first heat exchanger plate 14' that surrounds the planar openings 46, 48 formed in the first heat exchanger plate 14'. As well, the peripheral flange 68 that surrounds the openings 64, 66 formed in the downwardly projecting boss portions 60, 62 of the first heat exchanger plate 14' contacts and seals against the top surface 47 of the base portion 43 of the second heat exchanger plate 16 that surrounds the openings 80, 82 formed in the base portion 43 of the second heat exchanger plate 16.

Figure 9:
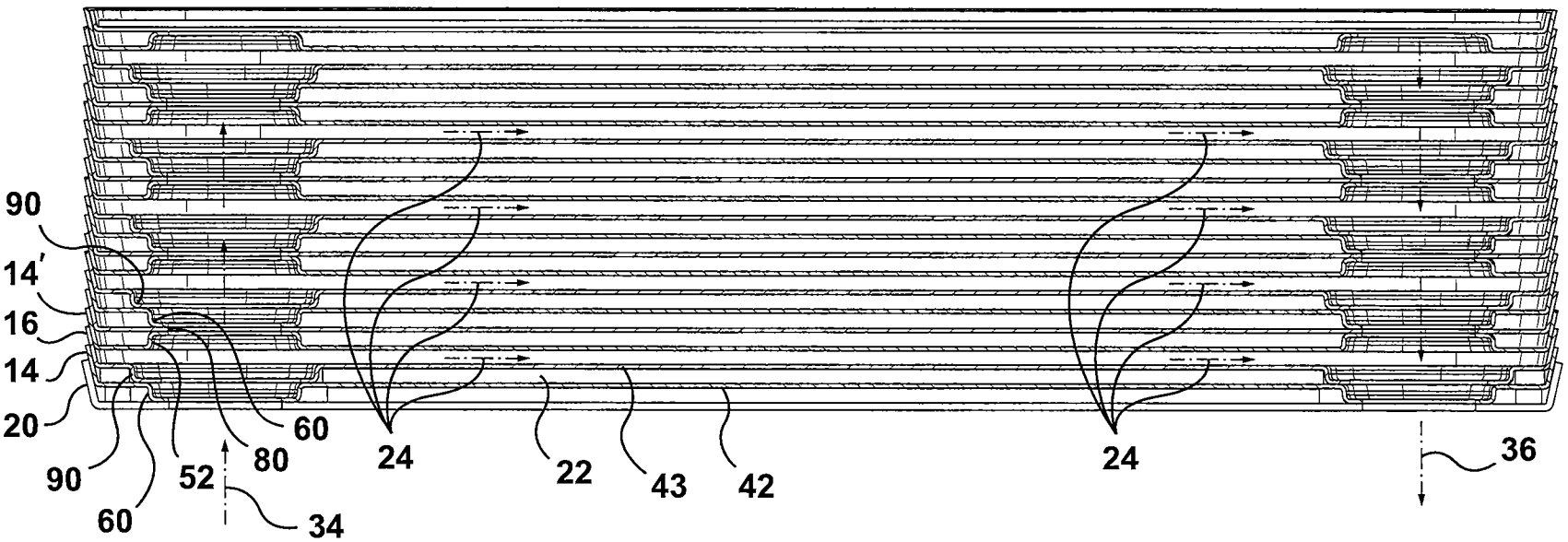
FIG. 9 is a cross-sectional view of the heat exchanger of FIG. 1 through the second set of manifolds.
Figure 10:
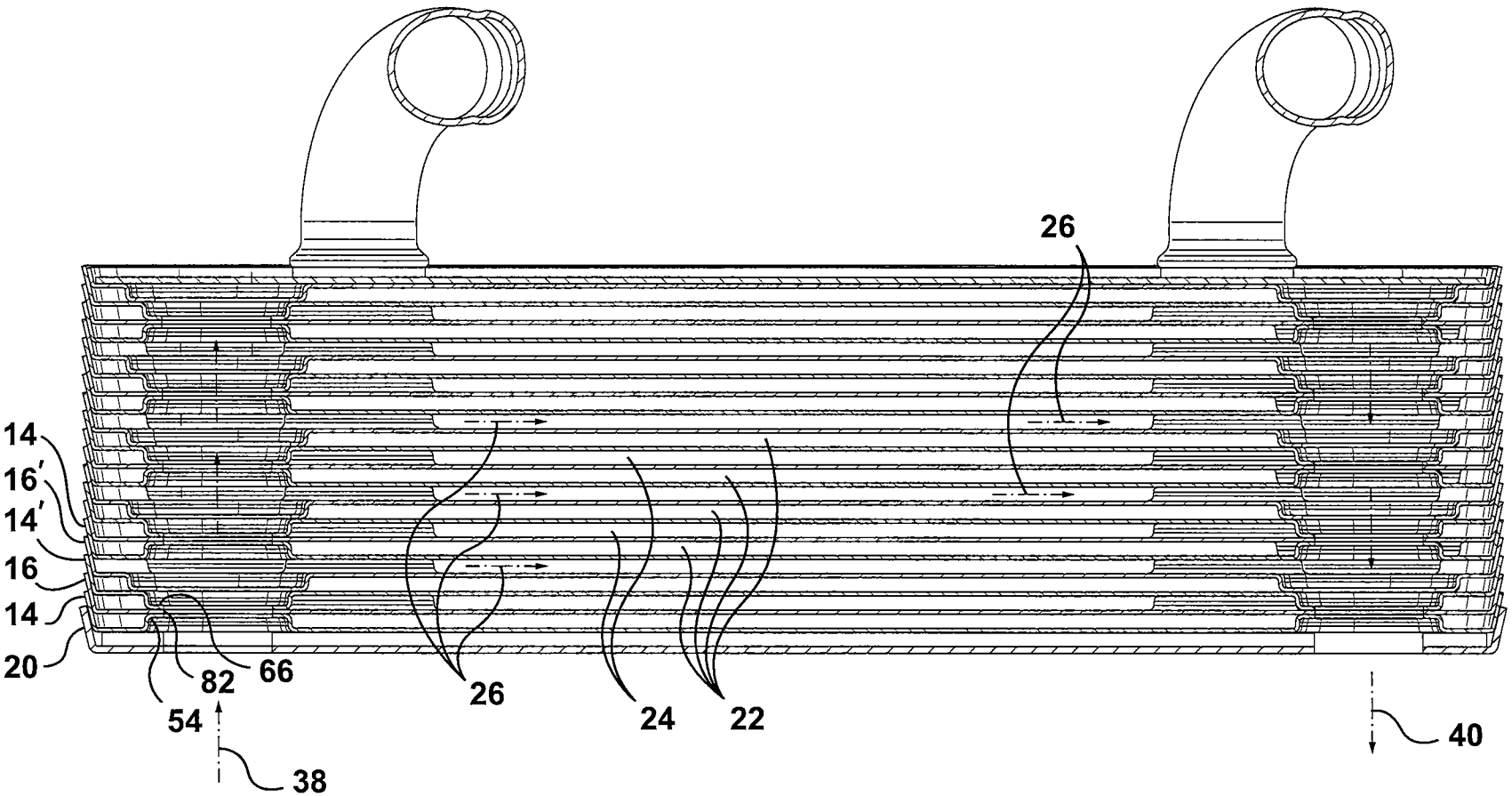
FIG. 10 is a cross-sectional view of the heat exchanger of FIG. 1 through the third set of manifolds.

The openings 84, 86 associated with the downwardly projecting boss portions 88, 90 formed in the second heat exchanger plate 16 remain spaced apart from the openings 54, 56 formed in the upwardly projecting boss portions 50, 52 formed in the first heat exchanger plate 14'. Due to the contact between the upwardly projecting boss portions 74, 76 formed in the second plate 16 (in its first orientation) and the bottom surface 41 of the first heat exchanger plate 14' (in its second orientation) as well as the contact between the downwardly projecting boss portions 60, 62 of the first heat exchanger plate 14' (in its second orientation) against the top surface 47 of the base portion 43 of the second plate 16, the base portions 42, 43 of the second heat exchanger plate 16 and first heat exchanger plate 14' are spaced apart from each other forming the second fluid flow passages 24 therebetween. Therefore, fluid entering/exiting the heat exchanger 10 through the inlet/outlet manifolds associated with the aligned, spaced apart openings 84, 86 in the downwardly projecting boss portions 88, 90 of the second heat exchanger plate 16 and the openings 54, 56 formed in the upwardly projecting boss portions 50, 52 of the adjacent first plate 14' is able to flow through the second fluid flow passages 24 formed in the space between the top surface 47 of the second plate 16 in its first orientation and the bottom surface 41 of the adjacent first heat exchanger plate 14' in its second orientation. FIG. 9 illustrates a cross-sectional view of the heat exchanger 10 through the axis along which the inlet and outlet manifolds located towards the rear of the heat exchanger 10 are arranged. As shown, a second heat exchange fluid entering/exiting the heat exchanger through the openings 84, 86 formed in the second heat exchanger plates 16 that are aligned with and spaced apart from the corresponding openings 54, 56 formed in the first heat exchanger plate 14' (in its second orientation) is able to enter/exit the second fluid flow passages 24, the second heat exchange fluid therefore being brought into heat transfer relationship with the first heat exchange fluid flowing through the adjacent first fluid flow passages 22. The sealing contact between the peripheral flange 78 that surrounds the first pair of openings 70, 72 formed in the upwardly projecting boss potions 74, 76 of the second heat exchanger plate 16 and the bottom surface 41 of the base portion 42 of the first heat exchanger plate 14' that surrounds the planar openings 46, 48 fluidly isolates or seals the second fluid flow passages 24 from the first fluid flow passages 22. As well, the sealing contact between the peripheral flange 68 that surrounds the openings 64, 66 formed in the downwardly projecting boss portions 60, 62 of the first heat exchanger plate 14' and the top surface 47 of the base portion 43 of the second heat exchanger plate 16 that surrounds the openings 80, 82 formed in the base portion 43 of the second heat exchanger plate 16 also fluidly isolates or seals the second fluid passages 24 from the first fluid flow passages 22.

When a second heat exchanger plate 16' in its second orientation is stacked on top of the first heat exchanger plate 14' in its second orientation, the second heat exchanger plate 16' has the location of its planar, openings 80, 82 and the openings 84, 86 associated with the downwardly projecting boss portions 88, 90 reversed as compared to when the second heat exchanger plate 16 is arranged in its first orientation. Therefore, when a second heat exchanger plate 16' in its second orientation is stacked on top of a first heat exchanger plate 14' that is also in its second orientation, the peripheral flange 58 associated with the upwardly projecting boss portions 50, 52 of the first heat exchanger plate 14' contacts and seals against the bottom surface 49 of the base portion 43 of the second heat exchanger plate 16' that surrounds the planar openings 80, 82 formed therein. As well, it is the peripheral flange 92 associated with the larger sized, downwardly projecting boss portions 88, 90 on the second heat exchanger plate 16' that contacts and seals against the top surface 39 of the base portion 42 of the first heat exchanger plate 14' that surrounds the openings or depressions 65 formed by the downwardly projecting boss portions 60, 62 of the first heat exchanger plate 14'. It is the contact between the upwardly projecting boss portions 50, 52 of the first heat exchanger plate 14' against the base portion 43 of the adjacent second heat exchanger plate 16' and the contact between the downwardly projecting boss portions 88, 90 of the second heat exchanger plate 16' against the base portion 42 of the first heat exchanger plate 14' that serves to space apart the base portions 42, 43 of the adjacent second heat exchanger plate 16' (in its second orientation) and first heat exchanger plate 14' (in its second orientation). Since the openings 46, 48 located along the central longitudinal axis of the first plate 14' are aligned with but remain spaced apart from the openings 70, 72 formed in the upwardly projecting boss portions 74, 76 of the adjacent second heat exchanger plate 16' (in its second orientation), it is the first heat exchange fluid flowing through inlet and outlet manifolds 30, 32 that gains access to the space between the first and second heat exchanger plates 14', 16'. Accordingly, a first fluid flow passage 22 is formed between the adjacent first and second heat exchanger plates 14', 16' when both plates are in their second orientations, the first fluid flow passage 22 being fluidly isolated from or sealed relative to the adjacent second fluid flow passage 24 and third fluid flow passage 26.

When a first heat exchanger plate 14 in its first orientation is stacked on top of the second heat exchanger plate 16' in its second orientation which completes the repeating pattern of plates that together form the stack of plates that form the heat exchanger core 12, as shown in FIG. 2, the peripheral flange 78 associated with the openings 70, 72 formed in the upwardly projecting boss portions 74, 76 of the second heat exchanger plate 16' contacts and seals against the bottom surface 41 of the base portion 42 of the first heat exchanger plate 14 that surrounds the first pair of planar openings 46, 48 formed therein. As well, the peripheral flange 68 associated with the openings 64, 66 formed in the downwardly projecting boss portions 60, 62 formed in the first heat exchanger plate 14 contacts and seals against the top surface 47 of the base portion 43 of the second heat exchanger plate 16' that surrounds planar openings 80, 82 formed in the base portion 43 of the second plate 16'. While the openings 84, 86 associated with the downwardly projecting boss portions 88, 90 of the second heat exchanger plate 16' (in its second orientation) are axially aligned the openings 54, 56 formed in the upwardly projecting boss portions 50, 52 of the adjacent first heat exchanger plate 14 (in its first orientation), they remain spaced apart from each other. Accordingly, fluid entering/exiting the heat exchanger 10 through the aligned openings 84, 86 of the second heat exchanger plate 16' (in its second orientation) and openings 54, 56 of the first heat exchanger plate 14 (in its first orientation), namely the fluid entering/exiting the heat exchanger 10 through the inlet and outlet openings formed towards the front of the heat exchanger 10, is able to flow through the third fluid flow passage 26 formed in between the top surface 47 of the second heat exchanger plate 16' (in its second orientation) and the bottom surface 41 of the first heat exchanger plate 14' (in its second orientation).

This alternating arrangement 14, 16, 14', 16', 14, 16, etc. continues throughout the heat exchanger core 12, the number of first and second plates 14, 16, 14', 16' in their first and second orientations being specifically selected to correspond to the desired number of fluid flow passages for each of the first, second and third sets of fluid flow passages 22, 24, 26. Typically, with this alternating arrangement of first and second heat exchanger plates 14, 16 in their alternating first and second orientations, the heat exchanger 10 provides an equal number of second and third fluid flow passages 24, 26 and double the number of first fluid flow passages 22. For instance, if the number of first and second heat exchanger plates 14, 16 is selected so that there are 10 first fluid flow passages 22, there will be a set of five second fluid flow passages 24 and a separate set of five third fluid flow passages 26.

Figure 6:
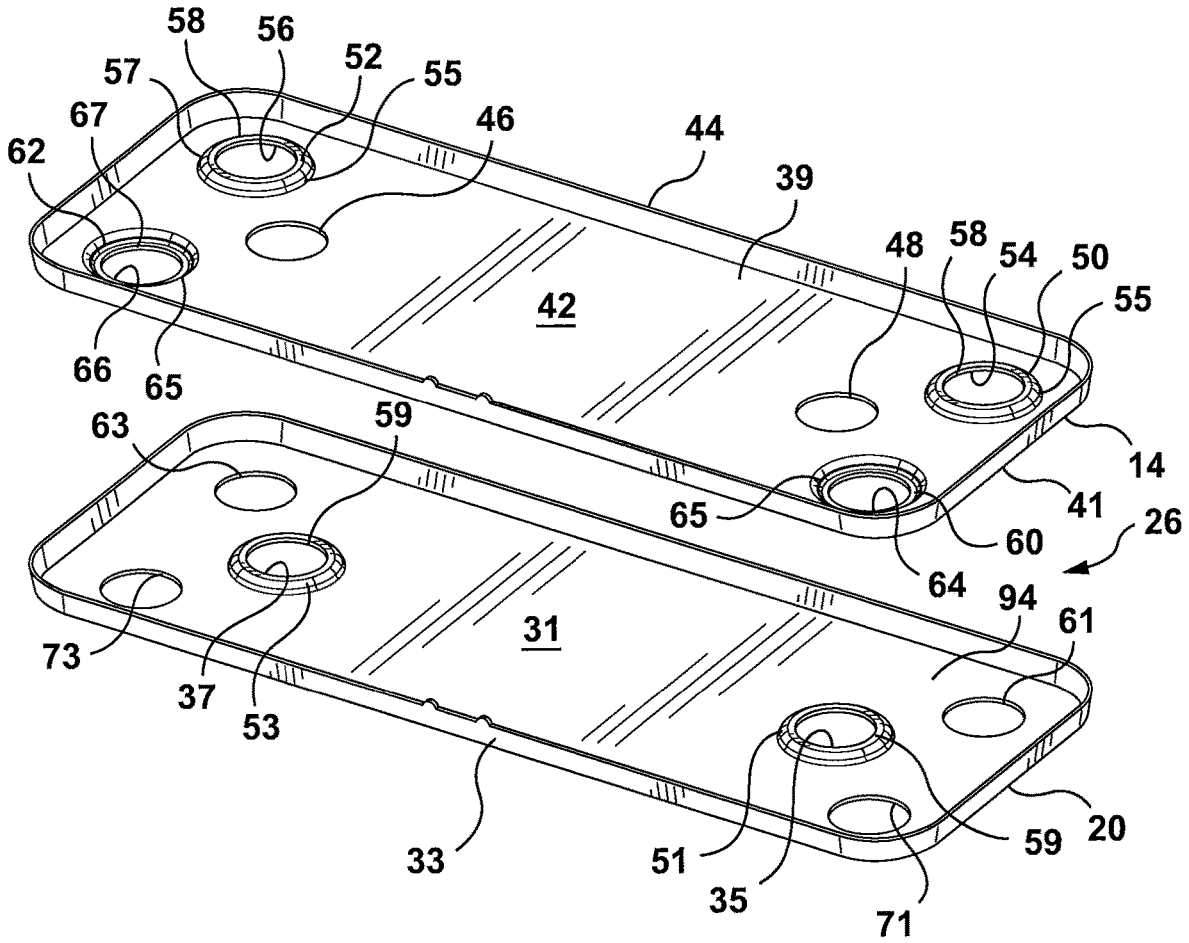
FIG. 6 is an exploded view of the bottom end plate of the heat exchanger and the adjacent first heat exchanger plate.
Figure 7:
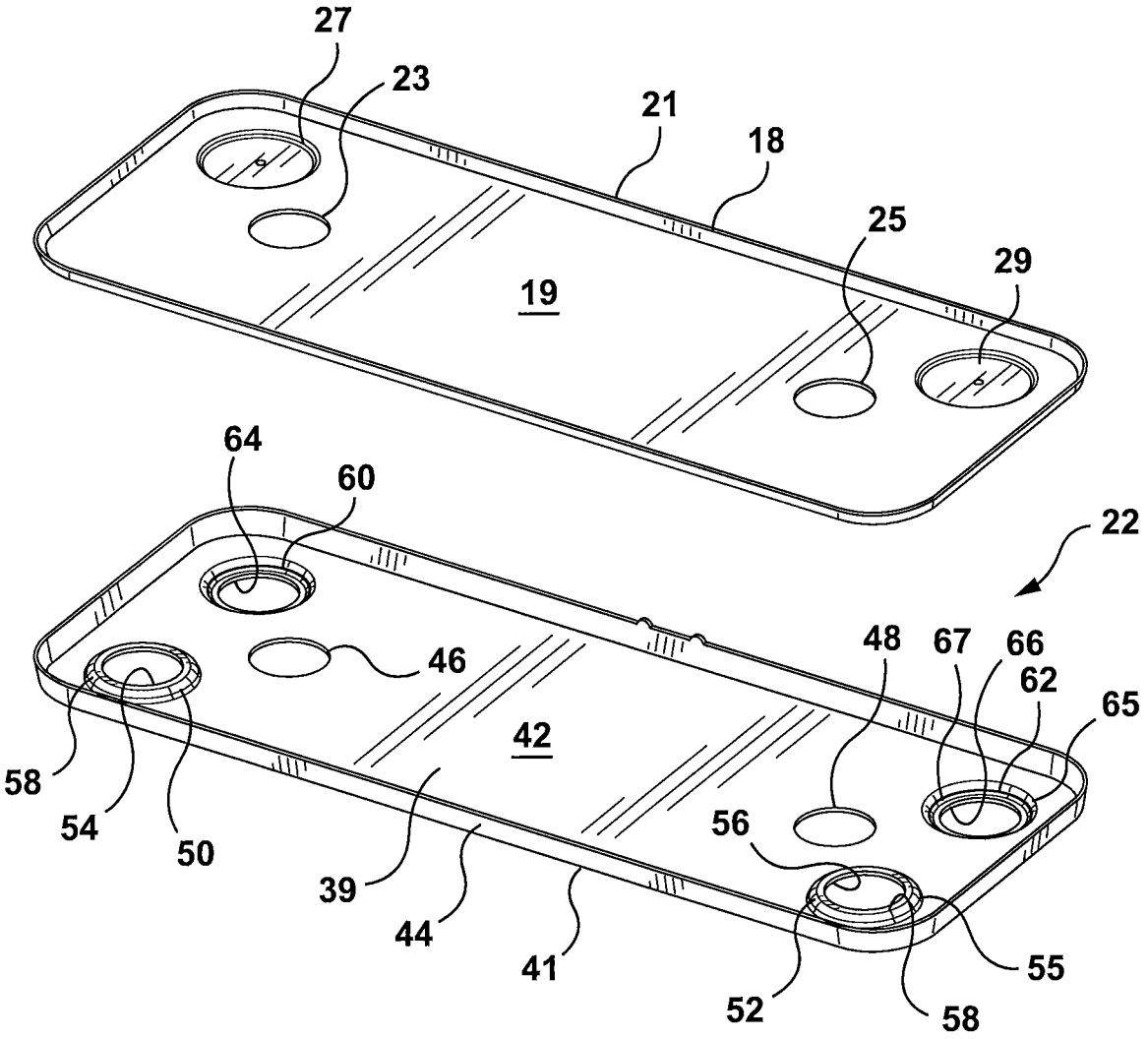
FIG. 7 is an exploded view of the uppermost heat exchanger plate and the adjacent top end plate or closure plate.

Top and bottom end plates 18, 20 that correspond to the uppermost and lowermost heat exchanger plates in the heat exchanger core 12 serve to enclose the heat exchanger core 12 are now described in detail having regard to FIGS. 6 and 7. In the subject example embodiment, inlet and outlet fittings 31, 33 associated with the first inlet manifold 30 and the first outlet manifold 32 for the flow of the first fluid through the heat exchanger 10 are arranged on the top of the heat exchanger 10 and are fluidly coupled to the aligned openings 46, 48, 70, 72 on the first and second heat exchanger plates 14, 16 that are arranged along the central, longitudinal axis of the heat exchanger 10, which openings 46, 48, 70, 72 provide access to the first fluid flow passages 22 formed within the heat exchanger core 12. Accordingly, top end plate 18 is also in the form of a dished-plate having a generally planar base portion 19 surrounded by an upstanding edge wall 21. A pair of openings 23, 25 is formed in the base portion 19 of the end plate 18 which are arranged at opposite ends of the end plate 18 along the central longitudinal axis of the top end plate 180. Accordingly, when top end plate 18 is arranged on top of the stack of alternating first and second heat exchanger plates 14, 16, openings 23, 25 align with the corresponding openings 46, 48, 74, 76 formed in the first and second heat exchanger plates 14, 16. A pair of depressions 27, 29 that project downwardly out of the plane of base portion 19 of the top end plate 18 are arranged so as to engage with and seal against the respective sidewalls that form the pair of downwardly projecting boss portions in the uppermost first or second plate 14, 16 within the heat exchanger core 12. In the illustrated embodiment, the uppermost heat exchanger plate is a first heat exchanger plate 14 in its first orientation so depressions 27, 29 are formed so as to engage and seal against the sidewall 67 associated with the downwardly projecting boss portions 60, 62 that are arranged towards the rear of the heat exchanger 10 while the base portion 19 seals against the peripheral flange 58 associated with the upwardly projecting boss portions 50, 52.

The bottom end plate 20 is also in the form of a dished-plate having a generally planar base portion 31 surrounded by an upstanding edge wall 33. Bottom end plate 20 is typically at least twice the thickness of one of the standard heat exchanger plates forming the heat exchanger core 12. The increased thickness is required to assist with the mounting of the heat exchanger core 12 to an appropriate base or mounting plate through brazing or any other suitable methods. In the illustrated embodiment, bottom end plate 20 is similar in structure to one of the second heat exchanger plates 16 in that the bottom end plate 20 is formed with a first pair of openings 35, 37 at opposite ends thereof with the openings 35, 37 being arranged so as to be generally in line with one another along the central, longitudinal axis of the end plate 20. Openings 35, 37 are formed in corresponding boss portions 51, 53 that project upwardly out of the plane of the base portion 31. A contact surface or peripheral flange 59 surrounds openings 35, 37 in boss portions 51, 53. The openings 35, 37 are sized so as to correspond to the size of the openings 46, 48 and 70, 72 in the first and second heat exchanger plates 14, 16, the openings 35, 37 in the bottom end plate 20 aligning with the axially aligned openings 46, 48 and 70, 72 of the first and second plates 14, 16.

A second pair of openings 61, 63 are formed in the base portion 31 of the bottom end plate 20 at opposite ends thereof and are arranged so as to be generally in line with one another along the length of the bottom end plate 20 but disposed to one side of the central longitudinal axis of the end plate 20. The openings 61, 63 are formed within the surface of the base portion 31 of the bottom end plate 20 and are adapted to align with the corresponding second inlet and outlet manifolds formed by the corresponding aligned openings formed in the first and second heat exchanger plates 14, 16.

A third pair of openings 71, 73 is formed in the base portion 31 of the bottom end plate 20 at opposite ends thereof and are arranged so as to be generally in line with one another along the length of the bottom end plate 20. Openings 71, 73, however, are disposed on the opposite side of the central, longitudinal axis of the bottom end plate 20 as the second pair of openings 61, 63 and are adapted to align with the corresponding third inlet and third outlet manifolds formed by the corresponding aligned openings formed in the first and second heat exchanger plates 14, 16.

When the bottom end plate 20 is arranged at the bottom of the stack of first and second heat exchanger plates 14, 16 forming heat exchanger core 12, the peripheral flange 59 surrounding openings 51, 53 contacts and seals against the bottom surface 41 of the adjacent first heat exchanger plate 14 while the peripheral flange 68 surrounding openings 64, 66 formed in the downwardly projecting bosses 60, 62 of the first heat exchanger plate 14 contacts and seals against the base portion 31 of the bottom end plate 20. The openings 54, 56 formed in the upwardly projecting boss portions 50, 52 of the first heat exchanger plate 14 remain spaced apart from the openings 71, 73. Accordingly, a third fluid flow passage 26 is formed between the bottom surface 41 of the base portion 42 of the first heat exchanger plate 14 and the base portion 31 of the bottom end plate 20.

In accordance with principles known in the art, heat transfer surfaces 94 in the form of turbulizers or corrugated fins can be arranged between the first and second heat exchanger plates 14, 16 throughout the heat exchanger core 12. Accordingly, heat transfer surfaces 94 can be arranged in each of the first fluid flow passages 22, second fluid flow passages 24 and third fluid flow passages 26. Alternatively, heat transfer surfaces 94 can be arranged in only the second and third fluid flow passages 24, 26 or any other combination of fluid flow passages that is deemed appropriate for a particular application. As well, different types of heat transfer surfaces can be used in the different fluid flow passages 22, 24, 26 in order to assist with improving heat transfer properties of the specific heat exchange fluid flowing within the respective fluid flow passages 22, 24, 26. A heat transfer surface 94 is schematically illustrated in FIG. 2 as being arranged in one of the first fluid flow passages 22 between adjacent first and second heat exchanger plates 14, 16 in their first orientations, while a heat transfer surface 94 is also illustrated in FIG. 6 as being arranged in one of the third fluid flow passages 26 formed between the bottom end plate 20 and the adjacent first heat exchanger plate 14. However, it will be understood that heat transfer surfaces 94 may be arranged in any of the fluid flow passages that form part of the heat exchanger core 12.

Accordingly, in some example embodiments, a three fluid heat exchanger 10 is provided wherein a first set of fluid flow passages 22 is brought into heat transfer relationship with both a second set of fluid flow passages and a third set of fluid flow passages that are adapted to receive separate fluid streams wherein the heat exchanger 10 is comprised of a plurality of first heat exchanger plates 14 and a plurality of second heat exchanger plates 16, the first and second heat exchanger plates 14, 16 each having first and second orientations when arranged in their alternating pattern through the heat exchanger stack. Given that only two types of heat exchanger plates 14, 16 are required to form the heat exchanger core 12 where each plate 14, 16 provides three different sealing surfaces each of which is disposed in a different plane, tooling costs may be reduced as compared to other known three fluid heat exchangers requiring more than two types of core plates.

Certain adaptations and modifications of the described embodiments can be made. Therefore, the above discussed embodiments are considered to be illustrative and not restrictive.

What is claimed is:

1. A multifluid heat exchanger comprising:

a plurality of first heat exchanger plates and a plurality of second heat exchanger plates, each of the first and second heat exchanger plates having a base portion surrounded by a peripheral edge wall, the plurality of first heat exchanger plates and the plurality of second heat exchanger plates being disposed in alternating stacked relationship such that the peripheral edge walls of adjacent first and second heat exchanger plates are disposed in sealing contact;

the first and second heat exchanger plates each having a first orientation and a second orientation such that while the plurality of first heat exchanger plates and the plurality of second heat exchanger plates are disposed in their alternating stacked relationship, each subsequent first heat exchanger plate is rotated 180 degrees about an axis normal to the base portion of the first heat exchanger plate relative to a previous first heat exchanger plate in the stack, and each subsequent second heat exchanger plate is rotated 180 degrees about an axis normal to the base portion of the second heat exchanger plate relative to a previous first heat exchanger plate in the stack;

a plurality of first fluid flow passages formed between adjacent first and second heat exchanger plates when both the first heat exchanger plate and the adjacent second heat exchanger plate are disposed in their first orientation or are both disposed in their second orientation;

a plurality of second fluid flow passages formed between adjacent second heat exchanger plates disposed in their first orientation and first heat exchanger plates disposed in their second orientation; and a plurality of third fluid flow passages formed between adjacent second heat exchanger plates disposed in their second orientation and first heat exchanger plates disposed in their first orientation;

wherein each first heat exchanger plate comprises:

a first pair of first fluid openings disposed within the plane of the base portion of the first heat exchanger plates;

a second pair of fluid openings that project out of the base portion of the first heat exchanger plates in a first direction such that the second pair of fluid openings are disposed in a first plate first sealing surface plane that is spaced apart from and parallel to, or substantially parallel to, the base portion; and a third pair of fluid openings that project out of the plane of the base portion of the first heat exchanger plates in a second direction opposite to the first direction such that the third pair of fluid openings are disposed in a first plate second sealing surface plane that is spaced apart from and parallel to, or substantially parallel to, the base portion; and wherein each second heat exchanger plate comprises:

a first pair of fluid openings that project out of the base portion of the second heat exchanger plates in a first direction such that the first pair of fluid openings are disposed in a second plate first sealing surface plane that is spaced apart from and parallel to, or substantially parallel to, the base portion;

a second pair of fluid openings disposed within the plane of the base portion of the second heat exchanger plates; and a third pair of fluid openings that project out of the plane of the base portion of the second heat exchanger plates in a second direction opposite to the first direction such that the third pair of fluid openings are disposed in a second plate second sealing surface plane that is spaced apart from and parallel to, or substantially parallel to, the base portion and disposed below both the second plate first sealing surface plane and the base portion of the second heat exchanger plates, wherein the third pair of fluid openings are larger than the first pair of fluid openings and the second pair of fluid openings of the second heat exchanger plates and are also larger than the first, second and third pairs of fluid openings in the plurality of first heat exchanger plates.

2. The multifluid heat exchanger as claimed in claim 1, further comprising:

a first pair of inlet and outlet manifolds in fluid communication with the plurality of first fluid flow passages for inletting and discharging a first heat exchange fluid to and from the heat exchanger;

a second pair of inlet and outlet manifolds in fluid communication with the plurality of second fluid flow passages for inletting and discharging a second heat exchange fluid to and from the heat exchanger;

a third pair of inlet and outlet manifolds in fluid communication with the plurality of third fluid flow passages for inletting and discharging a third heat exchange fluid to and from the heat exchanger;

wherein the plurality of first, second and third fluid flow passages are arranged in an alternating pattern through the heat exchanger core such that the plurality of first fluid flow passages are disposed in heat transfer relationship with both the plurality of second fluid flow passages and the plurality of third fluid flow passages.

3. The multifluid heat exchanger as claimed in claim 2, wherein:

the first pair of fluid openings of the first heat exchanger plates are disposed such that one opening of the first pair of fluid openings is disposed at opposite ends of the first heat exchanger plates, the fluid openings being spaced apart from each other and aligned with each other along a central longitudinal axis of the heat exchanger.

4. The multifluid heat exchanger as claimed in claim 3, wherein:

the second pair of fluid openings of the first heat exchanger plates are disposed in corresponding boss portions that project out of a top surface of the base portion of the first heat exchanger plates, each of the fluid openings in the second pair of fluid openings being surrounded by a sealing surface disposed in the first plate first sealing surface plane, the corresponding boss portions being arranged at opposite ends of the first heat exchanger plates and aligned with each other along an axis that extends parallel to, or substantially parallel to, the central longitudinal axis of the heat exchanger and disposed to one side of the central longitudinal axis of the heat exchanger; and the third pair of fluid openings of the first heat exchanger plates are disposed in corresponding boss portions that project out of a bottom surface of the base portion of the first heat exchanger plates in a second direction that is opposite to the first direction, each of the fluid openings in the third pair of fluid openings being surrounded by a sealing surface disposed in the first plate second sealing surface plane that is disposed below and parallel to, or substantially parallel to, the base portion, the corresponding boss portions being arranged at opposite ends of the first heat exchanger plates and aligned with each other along an axis that extends parallel to, or substantially parallel to, the central longitudinal axis of the heat exchanger and disposed to one side of the central longitudinal axis of the heat exchanger such that the pair of third fluid openings is disposed to an opposite side of the central longitudinal axis of the heat exchanger as the second pair of fluid openings.

5. The multifluid heat exchanger as claimed in claim 2, wherein:

the first pair of fluid openings of the second heat exchanger plates are disposed in corresponding boss portions that project out of a top surface of the base portion of the second heat exchanger plates, each of the fluid openings in the first pair of fluid openings being surrounded by a sealing surface disposed in the second plate first sealing surface plane, the corresponding boss portions being arranged at opposite ends of the second heat exchanger plates and aligned with each other along a central longitudinal axis of the heat exchanger;

the second pair of fluid openings in the second heat exchanger plates are disposed such that one opening of the second pair of fluid openings is disposed at opposite ends of the first heat exchanger plates and aligned with each other along an axis that extends parallel to, or substantially parallel to, the central longitudinal axis of the heat exchanger and disposed to one side of the central longitudinal axis of the heat exchanger; and the third pair of fluid openings in the second heat exchanger plates are disposed in corresponding boss portions that project out of a bottom surface of the base portion of the second heat exchanger plates in a second direction that is opposite to the first direction, each of the fluid openings in the third pair of fluid openings being surrounded by a sealing surface disposed in the second plate second sealing surface plane that is disposed below and parallel to, or substantially parallel to, the base portion of the second heat exchanger plates, the corresponding boss portions being arranged at opposite ends of the second heat exchanger plates and aligned with each other along an axis that extends parallel to, or substantially parallel to, the central longitudinal axis of the heat exchanger and disposed to one side of the central longitudinal axis of the heat exchanger such that the pair of third fluid openings is disposed to an opposite side of the central longitudinal axis of the heat exchanger as the second pair of fluid openings.

6. The multifluid heat exchanger as claimed in claim 1, wherein the first pair of fluid openings, the second pair of fluid opening and the third pair of fluid openings in both the first heat exchanger plates and the second heat exchanger plates are circular openings.

7. The multifluid heat exchanger as claimed in claim 1, wherein the first pair of fluid openings, the second pair of fluid opening and the third pair of fluid openings in both the first heat exchanger plates and the second heat exchanger plates are non-circular openings.

8. The multifluid heat exchanger as claimed in claim 1, wherein the fluid openings of the first, second and third pairs of fluid openings that are disposed at each respective end of the first and second heat exchanger plates are aligned with each other along an axis that extends parallel, or substantially parallel to a transverse axis of the heat exchanger.

9. The multifluid heat exchanger as claimed in claim 1, wherein the first pair of openings formed in the base portion of each of the first heat exchanger plates are inwardly disposed from the respective ends of the first heat exchanger plates along the central, longitudinal axis of the heat exchanger relative to the disposition of the second and third pairs of openings formed in the first heat exchanger plates at the corresponding respective ends of the first heat exchanger plates; and wherein the first pair of openings and corresponding upwardly projecting boss portions formed in the second heat exchanger plates are inwardly disposed from the respective ends of the second heat exchanger plates along the central, longitudinal axis of the heat exchanger relative to the disposition of the second and third pairs of openings formed in the second heat exchanger plates at the corresponding respective ends of the second heat exchanger plates.

10. The multifluid heat exchanger as claimed in claim 1, wherein a heat transfer surface is disposed in at least one of the plurality of first fluid flow passages, the plurality of second fluid flow passages and the plurality of third fluid flow passages.

11. The multifluid heat exchanger as claimed in claim 1, wherein a first heat transfer surface is disposed in each of the plurality of second fluid flow passages and a second heat transfer surface, that is different to the first heat transfer surface, is disposed in each of the plurality of third fluid flow passages.

12. The heat exchanger as claimed in claim 1, wherein the first, second and third pairs of fluid openings formed in the first heat exchanger plates and the first, second and third pairs of fluid openings formed in the second heat exchanger plates are non-circular.

13. The heat exchanger as claimed in claim 12, wherein the corresponding boss portions of the second and third pairs of fluid openings in the first heat exchanger plates and the corresponding boss portions of the first pair of fluid openings and third pair of fluid openings in the second heat exchanger plates are non-circular and correspond to the shape of the corresponding fluid opening.

14. A heat exchanger, comprising:

a plurality of first heat exchanger plates and a plurality of second heat exchanger plates, each of the first and second heat exchanger plates having a base portion surrounded by a peripheral edge wall, the base portion of each of the first and second plates having a top surface and a bottom surface;

wherein each of the first heat exchanger plates comprises:

a first pair of fluid openings formed in the base portion such that the first pair of fluid openings are co-planar, or substantially, co-planar with the base portion, with one opening of the first pair of fluid openings being formed at opposite ends of the first heat exchanger plates, the fluid openings being spaced apart from each other and aligned with each other along a central longitudinal axis of the heat exchanger;

a second pair of fluid openings formed in corresponding boss portions that project out of the top surface of the base portion, each of the fluid openings in the second pair of fluid openings being surrounded by a sealing surface disposed in a first plate first sealing surface plane that is disposed above and parallel to, or substantially parallel to, the base portion, the corresponding boss portions being arranged at opposite ends of the first heat exchanger plates and aligned with each other along an axis that extends parallel to, or substantially parallel to, the central longitudinal axis of the heat exchanger and disposed to one side of the central longitudinal axis of the heat exchanger; and a third pair of fluid openings formed in corresponding boss portions that project out of the bottom surface of the base portion in a second direction that is opposite to the first direction, each of the fluid openings in the third pair of fluid openings being surrounded by a sealing surface disposed in a first plate second sealing surface plane that is disposed below and parallel to, or substantially parallel to, the base portion, the corresponding boss portions being arranged at opposite ends of the first heat exchanger plates and aligned with each other along an axis that extends parallel to, or substantially parallel to, the central longitudinal axis of the heat exchanger and disposed to one side of the central longitudinal axis of the heat exchanger such that the pair of third fluid openings is disposed to an opposite side of the central longitudinal axis of the heat exchanger as the second pair of fluid openings; and wherein each of the second heat exchanger plates comprises:

a first pair of fluid openings formed in corresponding boss portions that project out of the top surface of the base portion of the second heat exchanger plates in a first direction, each of the fluid openings in the first pair of fluid openings being surrounded by a sealing surface disposed in a second plate first sealing surface plane that is disposed above and parallel to, or substantially parallel to, the base portion, the corresponding boss portions being arranged at opposite ends of the second heat exchanger plates and aligned with each other along the central longitudinal axis of the heat exchanger;

a second pair of fluid openings formed in the base portion of each of the second heat exchanger plates such that the second pair of fluid openings are co-planar, or substantially, co-planar with the base portion of the second heat exchanger plates, with one opening of the second pair of fluid openings being formed at opposite ends of the second heat exchanger plates, the fluid openings being spaced apart from each other and aligned with each other along an axis that extends parallel to, or substantially parallel to, the central longitudinal axis of the heat exchanger and disposed to one side of the central longitudinal axis of the heat exchanger;

a third pair of fluid openings formed in corresponding boss portions that project out of the bottom surface of the base portion of each of the second heat exchanger plates in a second direction that is opposite to the first direction, each of the fluid openings in the third pair of fluid openings being surrounded by a sealing surface disposed in a second plate second sealing surface plane that is disposed below and parallel to, or substantially parallel to, the base portion, the corresponding boss portions being arranged at opposite ends of the first heat exchanger plates and aligned with each other along an axis that extends parallel to, or substantially parallel to, the central longitudinal axis of the heat exchanger and disposed to one side of the central longitudinal axis of the heat exchanger such that the pair of third fluid openings is disposed to an opposite side of the central longitudinal axis of the heat exchanger as the second pair of fluid openings;

wherein:

the first heat exchanger plates and the second heat exchanger plates are disposed in an alternating, stacked relationship such that the peripheral edge wall of each first heat exchanger plate is disposed in sealing contact with the peripheral edge wall of an adjacent second heat exchanger plate in a fluid tight manner, the first heat exchanger plates and the second heat exchanger plates each having a first orientation and a second orientation wherein the second orientation of either the first or second heat exchanger plates is such that the first or second heat exchanger plate is rotated 180 degrees about an axis that extends normal to the base portion of either the first or second heat exchanger plate relative to a previous first or second heat exchanger plate disposed in its first orientation, the first and second heat exchanger plates being alternatingly stacked together such that each subsequent first or second heat exchanger is disposed in its second orientation relative to the previous first or second heat exchanger plate in the stack;

a plurality of first fluid flow passages formed between adjacent first and second heat exchanger plates when both the first heat exchanger plate and the adjacent second heat exchanger plate are disposed in their first orientation or are both disposed in their second orientation;

a plurality of second fluid flow passages formed between adjacent second heat exchanger plates disposed in their first orientation and first heat exchanger plates in their second orientation;

a plurality of third fluid flow passages formed between adjacent second heat exchanger plates in their second orientation and first heat exchanger plates in their first orientation;

a first pair of inlet and outlet manifolds in fluid communication with the plurality of first fluid flow passages for inletting and discharging a first heat exchange fluid to and from the heat exchanger;

a second pair of inlet and outlet manifolds in fluid communication with the plurality of second fluid flow passages for inletting and discharging a second heat exchange fluid to and from the heat exchanger;

a third pair of inlet and outlet manifolds in fluid communication with the plurality of third fluid flow passages for inletting and discharging a third heat exchange fluid to and from the heat exchanger;

wherein the plurality of first, second and third fluid flow passages are arranged in an alternating pattern through the heat exchanger core such that the plurality of first fluid flow passages are disposed in heat transfer relationship with both the plurality of second fluid flow passages and the plurality of third fluid flow passages.

15. The heat exchanger as claimed in claim 14, wherein the first pair of openings and corresponding upwardly projecting boss portions of the second heat exchanger plates have the same size as the second and third pairs of fluid openings and corresponding boss portions formed in the first heat exchanger plates.

16. The heat exchanger as claimed in claim 14, wherein the first pair of fluid openings, the second pair of fluid opening and the third pair of fluid openings in the first heat exchanger plates are circular openings, each circular opening defining a diameter, wherein the diameter of the first pair of fluid openings, the diameter of the second pair of fluid opening and the diameter of the third pair of fluid openings are all the same.

17. The heat exchanger as claimed in claim 14, wherein the first pair of fluid openings, the second pair of fluid openings and the third pair of fluid openings in the second heat exchanger plates are circular openings that each define a diameter, the diameter of the third pair of fluid openings being larger than the diameter of the first pair of fluid openings and the diameter of the second pair of fluid openings, the diameter of the first pair of fluid openings and the diameter of the second pair of fluid openings being the same.

18. The heat exchanger as claimed in claim 14, wherein the first pair of openings in the plurality of first heat exchanger plates and the first pair of openings and corresponding upwardly projecting boss portions of the plurality of second heat exchanger plates cooperate and align with each other when the plurality of first and second heat exchanger plates are stacked in their alternating relationship to form the first pair of inlet and outlet manifolds.

19. The heat exchanger as claimed in claim 14, wherein the second pair of openings and corresponding upwardly projecting boss portions of the first heat exchanger plates in their first orientation cooperate and align with the second pair of fluid openings formed in the base portion of the second heat exchanger plates in their first orientation, while the third pair of fluid openings and corresponding downwardly projecting boss portions of the first heat exchanger plates in their second orientation cooperate and align with the third pair of openings and corresponding downwardly projecting boss portions formed in the second heat exchanger plates in their second orientation when the first and second heat exchanger plates are stacked in their alternating relationship to form the second pair of inlet and outlet manifolds.

20. The heat exchanger as claimed in claim 14, wherein the third pair of openings and corresponding downwardly projecting boss portions of the first heat exchanger plates in their first orientation cooperate and align with the third pair of fluid openings and corresponding downwardly projecting boss portions of the second heat exchanger plates in their first orientation, while the second pair of fluid openings and corresponding upwardly projecting boss portions of the first heat exchanger plates in their second orientation cooperate and align with the second pair of fluid openings formed in the base portion of the second heat exchanger plates in their second orientation when the first and second heat exchanger plates are stacked in their alternating relationship to form the third pair of inlet and outlet manifolds.

21. The heat exchanger as claimed in claim 14, wherein the first pair of openings formed in the base portion of each of the first heat exchanger plates are inwardly disposed from the respective ends of the first heat exchanger plates along the central, longitudinal axis of the heat exchanger relative to the disposition of the second and third pairs of openings formed in the first heat exchanger plates at the corresponding respective ends of the first heat exchanger plates; and wherein the first pair of openings and corresponding upwardly projecting boss portions formed in the second heat exchanger plates are inwardly disposed from the respective ends of the second heat exchanger plates along the central, longitudinal axis of the heat exchanger relative to the disposition of the second and third pairs of openings formed in the second heat exchanger plates at the corresponding respective ends of the second heat exchanger plates.

22. The heat exchanger as claimed in claim 14, wherein each boss portion of the plurality of first heat exchanger plates and the plurality of second heat exchanger plates comprises a base disposed in the base portion of the first and second heat exchanger plates, a peripheral flange defining the corresponding sealing surface surrounding the corresponding fluid opening, and a sidewall extending from the base to the peripheral flange, the base of each boss portion defines a corresponding boss portion base opening, the boss portion base opening being disposed in the other one of the top surface or the bottom surface of the base portion from which the corresponding boss portion projects, the boss portion base opening having a diameter that is larger than the diameter of the fluid opening formed within the corresponding boss portion.

23. The heat exchanger as claimed in claim 14, wherein a first heat transfer surface is disposed in the plurality of second fluid flow passages and a second heat transfer surface that is different to the first heat transfer surface is disposed in the plurality of third fluid flow passages.

* * * * *